US009851650B2

(12) United States Patent
Isono et al.

(10) Patent No.: US 9,851,650 B2
(45) **Date of Patent: *Dec. 26, 2017**

(54) TONER AND METHOD FOR PRODUCING TONER

(71) Applicant: CANON KABUSHIKI KAISHA, Tokyo (JP)

(72) Inventors: Naoya Isono, Suntou-gun (JP); Yoshihiro Nakagawa, Numazu (JP); Harumi Takada, Susono (JP); Reo Tagawa, Susono (JP); Shiro Kuroki, Suntou-gun (JP); Sara Yoshida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/146,817

(22) Filed: May 4, 2016

(65) Prior Publication Data

US 2016/0327882 A1 Nov. 10, 2016

(30) Foreign Application Priority Data

May 8, 2015 (JP) ..... 2015-095773

(51) Int. Cl.
*G03G 9/087* (2006.01)
*G03G 9/08* (2006.01)

(52) U.S. Cl.
CPC ..... *G03G 9/08788* (2013.01); *G03G 9/0806* (2013.01); *G03G 9/08795* (2013.01); *G03G 9/08797* (2013.01)

(58) Field of Classification Search
CPC ..... G03G 9/08786; G03G 9/08788; G03G 9/08755; G03G 9/08708
See application file for complete search history.

(56) References Cited

U.S. PATENT DOCUMENTS

2014/0186760 A1* 7/2014 Kawaguchi ..... G03G 9/09775 430/108.3
2014/0186761 A1* 7/2014 Abe ..... G03G 9/09775 430/108.3
2014/0186762 A1* 7/2014 Abe ..... G03G 9/09 430/108.21
2014/0302437 A1 10/2014 Shimano et al.
2015/0099222 A1* 4/2015 Terui ..... G03G 9/08708 430/109.3
2015/0153666 A1* 6/2015 Isono ..... G03G 9/0804 430/109.3

(Continued)

FOREIGN PATENT DOCUMENTS

JP S62-273574 A 11/1987
JP 2006-146056 A 6/2006

(Continued)

*Primary Examiner* — Peter Vajda
(74) *Attorney, Agent, or Firm* — Canon U.S.A., Inc. IP Division

(57) ABSTRACT

A toner contains a styrene acrylic resin, a block polymer, and an organosilicon polymer, in which the organosilicon polymer has a specific partial structure, the block polymer has a polyester segment and a vinyl polymer segment, the melting point is 55° C. or more and 90° C. or less, the mass ratio of the polyester segment to the vinyl polymer segment is 40/60 to 80/20, and the polyester segment has a specific unit.

8 Claims, 1 Drawing Sheet

(56) References Cited

U.S. PATENT DOCUMENTS

| | | | | |
|---|---|---|---|---|
| 2015/0153668 | A1* | 6/2015 | Tanaka | G03G 9/0804 430/109.3 |
| 2015/0153669 | A1* | 6/2015 | Yoshida | G03G 9/0804 430/109.3 |
| 2015/0153670 | A1* | 6/2015 | Shimano | G03G 9/08755 430/109.3 |
| 2015/0261110 | A1* | 9/2015 | Nakagawa | G03G 9/0804 430/137.1 |

FOREIGN PATENT DOCUMENTS

| | | | |
|---|---|---|---|
| JP | 2006-169509 | A | 6/2006 |
| JP | 5084482 | B2 | 11/2012 |
| JP | 2014-130242 | A | 7/2014 |

* cited by examiner

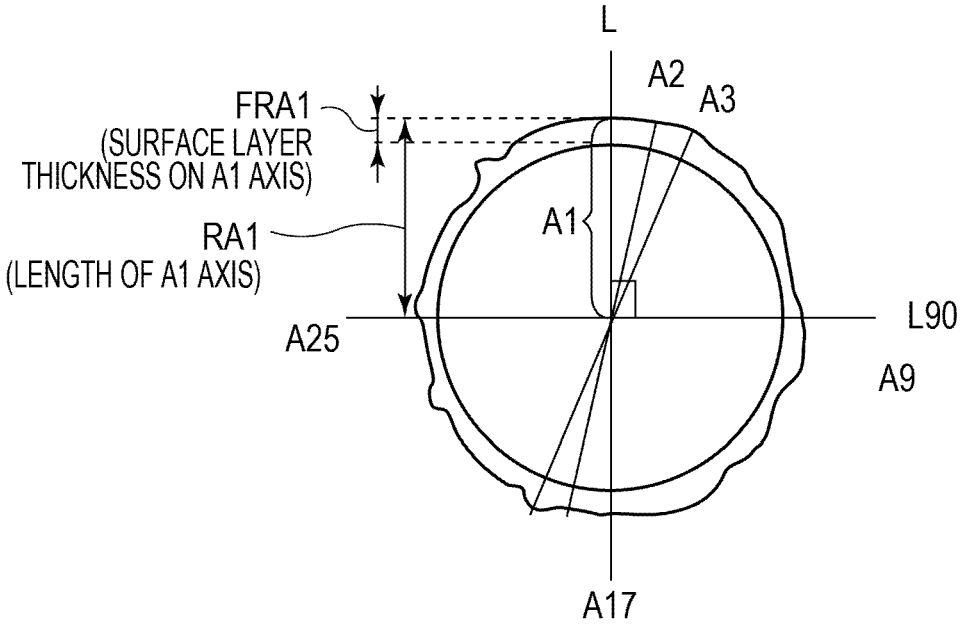
L
A2
A3
FRA1
(SURFACE LAYER
THICKNESS ON A1 AXIS)
A1
RA1
(LENGTH OF A1 AXIS)
A25
L90
A9
A17

TONER AND METHOD FOR PRODUCING TONER

BACKGROUND OF THE INVENTION

Field of the Invention

The present disclosure relates to a toner for use in image formation methods, such as electrophotography, an electrostatic recording method, and a toner jet method, and a method for producing the toner.

Description of the Related Art

A technique of visualizing image information through an electrostatic latent image, such as electrophotography, has been used in various fields, such as copying machines and printers. In recent years, it has been demanded more than before that the image quality is high, the energy is saved, the lifetime is long, and the storageability is stable.

In the viewpoint of high image quality and energy saving, Japanese Patent No. 5084482 discloses a method for reducing the softening point of a toner by blending a crystalline resin in a binding resin in toner particles. Thus, the low-temperature fixability and the gross are improved and energy saving and high image quality are improved.

On the other hand, in the viewpoint of long lifetime and high storage stability, Japanese Patent Laid-Open No. 2006-146056 discloses a method for strongly sticking toner particle surfaces with inorganic particles. Thus, high-temperature storage stability and printing durability in a normal temperature and normal humidity environment or in a high temperature and high humidity environment in printing are improved.

SUMMARY OF THE INVENTION

As described in the literatures described above, each problem has been solved, and thus a stabilized image has been able to be obtained.

However, an improvement is required for achieving both energy saving and long lifetime/storage stability, and a toner is required to achieve both low-temperature fixability and storage stability/durability. In particular, a toner containing a crystalline resin is likely to suffer from a phenomenon (hereinafter also referred to as "bleed"), in which a release agent and a binding resin component in the toner ooze out to the surface from the inside of the toner due to a reduction in the softening point. Thus, the long lifetime/storage stability have decreased, so that there has been room for an improvement of achieving energy saving and long lifetime/storage stability.

The present disclosure provides a toner having excellent low-temperature fixability and having excellent storage stability and durability.

The present disclosure provides a toner including a toner particle having a surface layer, in which the toner particle contains a styrene acrylic resin and a block polymer, the surface layer contains an organosilicon polymer, the organosilicon polymer has a partial structure represented by the following formula (1) or (2), the block polymer has a polyester segment C and a vinyl polymer segment A, the melting point (Tm) of the block polymer is 55° C. or more and 90° C. or less, the mass ratio of the polyester segment C to the vinyl polymer segment A (C/A ratio) is 40/60 or more and 80/20 or less, and the polyester segment C has a structural unit represented by the following formula (3).

(1)

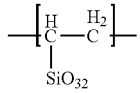

(2)

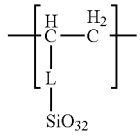

(In Formula (2), L represents a methylene group, an ethylene group, or a phenylene group.)

(3)

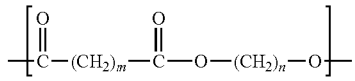

(In Formula (3), m and n each independently represent an integer of 4 or more and 16 or less.)

Further features of the present disclosure will become apparent from the following description of exemplary embodiments with reference to the attached drawing.

BRIEF DESCRIPTION OF THE DRAWING

FIG. 1 is a view showing an example of a cross-sectional image of a toner particle observed by using a transmission electron microscope (TEM).

DESCRIPTION OF THE EMBODIMENTS

Hereinafter, an embodiment of the present disclosure is specifically described.

The toner of the present disclosure has toner particles having a surface layer containing an organosilicon polymer and the toner particle has a styrene acrylic resin and a block polymer.

The organosilicon polymer has a partial structure represented by the following formula (1) or (2). The block polymer has a polyester segment C and a vinyl polymer segment A. The polyester segment C has a structural unit represented by the following formula (3).

(1)

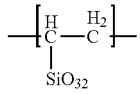

(2)

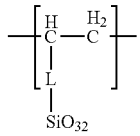

(In Formula (2) L represents a methylene group, an ethylene group, or a phenylene group.)

(3)

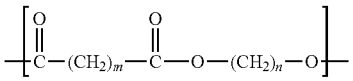

(In Formula (3), m and n each independently represent an integer of 4 or more and 16 or less.)

The melting point (Tm) of the block polymer is 55° C. or more and 90° C. or less and the mass ratio of the polyester segment C to the vinyl polymer segment A (C/A ratio) is 40/60 or more and 80/20 or less.

The present inventors have found that a toner excellent in low-temperature fixability and excellent also in storage stability and durability is obtained by the use of a styrene acrylic resin, a specific block polymer, and a specific organosilicon polymer.

Since the block polymer for use in the present disclosure is a resin having crystallinity (hereinafter referred to as a crystalline resin), the resin has a sharp melt property and excellent low-temperature fixability but has low elasticity and poor mechanical strength. Therefore, when the crystalline resin is used alone as the binding resin, sufficient durability is hard to obtain, and thus adverse effects in an image, such as vertical streak in a paper discharge direction resulting from toner melt-adhesion to members, such as a developing roller, are likely to occur. Then, in the present disclosure, it has been found that, by the use of a styrene acrylic resin and a specific block polymer in combination as the binding resin, the problems can be solved while maintaining low-temperature fixability and a fixing region width. Due to the fact that the block polymer of the present disclosure has the vinyl polymer segment A having high affinity with the styrene acrylic resin, the block polymer is sufficiently dispersed in the styrene acrylic resin in the toner. Thus, it is considered that the toughness of the toner particles is maintained, and thus high durability is obtained.

On the other hand, in a fixing process, when heat is supplied to the toner, the block polymer is instantly dissolved in the styrene acrylic resin from the vinyl polymer segment A as the starting point to demonstrate a plasticizing effect. Thus, the softening point of the toner decreases and low-temperature fixability is achieved. It is also considered that, due to the fact that the block polymer has the vinyl polymer segment A, the block polymer is imparted with moderate viscosity required for fixation after melting, so that the block polymer works as the binding resin, and thus low-temperature fixability is synergistically achieved.

The organosilicon polymer of the present disclosure is an organic-inorganic hybrid resin having the partial structure represented by Formula (1) or (2) above. By the surface migration property of the organosilicon polymer itself, the organosilicon polymer is present on the surface side of the toner particle to form a firm toner particle surface layer, so that high durability and developability stable over a long period of time are obtained.

With respect to the four valences of the Si atom of the organosilicon polymer, one valence is bonded to the following formula (iii) or (iv) and the remaining three valances are bonded to the O atoms.

(iii)

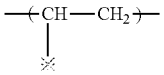

-continued (iv)

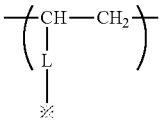

(* represents a bonding site with the silicon atom. L in Formula (iv) represents a methylene group, an ethylene group, or a phenylene group.)

Both the two valences of the O atom are bonded to Si, i.e., configuring a siloxane bond (Si—O—Si). When the Si atom and the O atom as the organosilicon polymer are considered, the organosilicon polymer has three O atoms per two Si atoms, and thus the organosilicon polymer is represented by $—SiO_{3/2}$. The $—SiO_{3/2}$ structure of the organosilicon polymer can be considered to have characteristics similar to the characteristics of silica ($SiO_2$) configured from a large number of siloxane bonds. Therefore, it is considered that the toner of the present disclosure produces a situation similar to the case where silica is added to the surface as an external additive. Thus, it is considered that the surface of the toner particles can be strengthened.

On the other hand, due to the fact that the organosilicon polymer contains the structure represented by Formula (iii) or (iv), the organosilicon polymer can react with various polymerizable monomers, such as a vinyl polymerizable monomer which is a raw material of the styrene acrylic resin, to form a crosslinking structure. Therefore, it can be considered that the toner of the present disclosure can increase the adhesiveness between the inside of the toner particles and the surface layer and can achieve high durability and stable developability.

In general, a low molecular weight component (Mw: 2000 or less) of the crystalline resin has a melting point lower than that of the entire crystalline resin, and thus the low molecular weight component is a low melting point component of the crystalline resin. Therefore, when the toner containing the crystalline resin is allowed to stand at a high temperature, the low melting point component of the crystalline resin tends to bleed to easily cause blocking. By the use of the organosilicon polymer of the present disclosure forming inorganic crosslinking in addition to the block polymer, the present disclosure can sufficiently suppress the bleed of the low melting point component due to a shielding effect of the inorganic crosslinking. Thus, it is considered that excellent storage stability in which blocking is suppressed even when allowed to stand at a high temperature is obtained.

Organosilicon Polymer

The organosilicon polymer has the partial structure represented by Formula (1) or a formula (2) above. Due to the fact that the partial structure represented by Formula (1) or Formula (2) is contained, the bleed of the low melting point component of the crystalline resin is suppressed and excellent storage stability is obtained.

Examples of monomers for obtaining the organosilicon polymer having the partial structure represented by Formula (1) or (2) include compounds represented by the following formula (4) or (5).

(4)

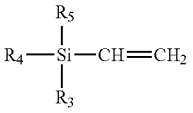

-continued

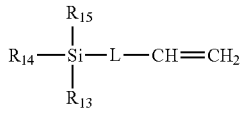

(5)

(In Formula (4) and Formula (5), $R_3$, $R_4$, $R_5$, $R_{13}$, $R_{14}$, and $R_{15}$ each independently represent a halogen atom, a hydroxy group, or an alkoxy group. In Formula (5), L represents a methylene group, an ethylene group, or a phenylene group.)

Examples of the compounds represented by Formula (4) or (5) include the following substances. Mentioned are trifunctional vinylsilanes, such as vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane; trifunctional allylsilanes, such as allyltrimethoxysilane, allyltriethoxysilane, allyldiethoxymethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyldiacetoxymethoxysilane, allyldiacetoxyethoxysilane, allylacetoxydimethoxysilane, allylacetoxymethoxyethoxysilane, allylacetoxydiethoxysilane, allyltrihydroxysilane, allylmethoxydihydroxysilane, allylethoxydihydroxysilane, allyldimethoxyhydroxysilane, allylethoxymethoxyhydroxysilane, and allyldiethoxyhydroxysilane, p-styryltrimethoxysilane, 3-metacryloxypropylmethyldimethoxysilane, 3-metacryloxypropylmethldiethoxysilane, 3-methacryloxypropyltriethoxysilane, and 3-acryloxyproprytrimethoxysilane.

In addition to the compounds represented by Formula (4) or (5), an organosilicon polymer may be obtained using organosilicon compounds shown below in combination. Examples of the organosilicon compounds include organosilicon compounds having four reactive groups in one molecule (tetrafunctional silane), organosilicon compounds having three reactive groups in one molecule (trifunctional silane), organosilicon compounds having two reactive groups in one molecule (bifunctional silane), or organosilicon compounds having one reactive group (monofunctional silane). Specific examples are mentioned below.

Mentioned are trifunctional methylsilanes, such as methyltrimethoxysilane, methyltriethoxysilane, methldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methldiethoxychlorosilane, methyltriacetoxysilane, methldiacetoxymethoxysilane, methldiacetoxyethoxysilane, methylacetoxydimethoxysilane, methylacetoxymethoxyethoxysilane, methylacetoxydiethoxysilane, methyltrihydroxysilane, methyldimethoxydihydroxysilane, methylethoxydihydroxysilane, methyldimethoxyhydroxysilane, methylethoxymethoxyhydroxysilane, and methldiethoxyhydroxysilane; trifunctional alkylsilanes, such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, and butyltrihydroxysilane; trifunctional hexylsilanes; such as hexyltrimethoxysilane, hexyltriethoxysilane, hexyltrichlorosilane, hexyltriacetoxysilane, and hexyltrihydroxysilane; and trifunctional phenylsilanes, such as phenyltrimethoxysilane, phenyltriethoxysilane, phenyltrichlorosilane, phenyltriacetoxysilane, and phenyltrihydroxysilane.

Moreover, mentioned are dimethyldiethoxysilane, tetraethoxysilane, hexamethyldisilazane, 3-glycidoxypropyltrimethoxysilane, 3-glycidoxypropylmethldiethoxysilane, 3-glycidoxypropyltriethoxysilane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltrimethoxysilane, 3-glycidoxypropylmethyldimethoxysilane, 3-glycidoxypropylmethyldimethoxysilane, hexamethyldisilane, tetraisocyanatesilane, methyltriisocyanatesilane, and vinyltriisocyanatesilane.

In the X ray photoelectron spectrometry (ESCA) of the toner particle surface, the ratio of the density of a silicon atom on the toner particle surface determined by the following expression (5) is suitably 1.0 atomic % or more.

$$\{dSi/(dC+dO+dSi+dS)\}\times 100 \quad (5)$$

In Expression (5), dC represents the density of the carbon atom, dO represents the density of the oxygen atom, dSi represents the density of the silicon atom, and dS represents the density of the sulfur atom.

The usually considered main atoms of the toner particles are carbon (C), oxygen (O), and sulfur (S). In the present disclosure, when a silicon (Si) atom is present on the toner particle surface, the $—SiO_{3/2}$ structure originating from the partial structure represented by Formula (1) or (2) is present. The ESCA analyzes the elements on the surface present with a thickness of several nanometers from the surface of toner particle to the center (middle point of the major axis) of the toner particle. A higher silicon atom density (dSi) means that a larger number of organosilicon polymers of the present disclosure are present on the toner particle surface.

The ratio of the density of the silicon atom determined by Expression (5) on the toner particle surface is preferably 2.5 atomic % or more. By adjusting the ratio of the density of the silicon atom to 2.5 atomic % or more, the surface free energy of the surface can be made small, the flowability can be improved, the occurrence of fogging can be suppressed, and the durability and the developability are improved. The density ratio is more preferably 5.0 atomic % or more. On the other hand, the density of the silicon atom on the toner particle surface is preferably 33.3 atomic % or less from the viewpoint of chargeability. The ESCA is the abbreviation for Electron Spectroscopy for Chemical Analysis.

The dSi can be controlled by a method for producing toner particles in the formation of the organosilicon polymer and the reaction temperature, the reaction time, the reaction solvent, and the pH in the formation of the organosilicon polymer. The dSi can also be controlled by the monomer type and amount of the organosilicon polymer.

The surface is a region of about 10.0 nm or less from the toner particle surface.

In the organosilicon polymer, the ratio of the organosilicon atoms having the structure represented by —$SiO_{3/2}$ among the organosilicon atoms contained in the toner particles is suitably 5.0% or more. When the ratio is 5.0% or more, the storage stability and the durability are more excellent.

The average thickness Dav. of the surface layer of the toner particle containing the organosilicon polymer measured by the observation of the cross section of the toner particle using a transmission electron microscope (TEM) is suitably 5.0 nm or more.

When the toner particle cross section is divided into 16 parts in such a manner that the crossed axes angles are equal (The crossed axes angle is 11.25° C.) with the intersection point of a major axis L which is the largest diameter of the toner particle cross section and an axis L90 passing through the middle point of the major axis L and perpendicular to the major axis L as the center, and the division axes each are defined as An (n=1 to 32) from the center to the toner particle surface, the average thickness Dav. refers to the average thickness of the surface layer of the toner particles containing the organosilicon polymer at 32 places on the division axes.

Thus, the occurrence of the bleed due to the mold release agent and the resin component present on the inner side relative to the surface layer of the toner particle is suppressed, and thus a toner excellent in storage stability, environmental stability, and development durability can be obtained. From the viewpoint of storage stability, the average thickness Dav. of the surface layer of the toner particle is 7.5 nm or more, and a more suitable range is 10.0 nm or more. From the viewpoint of obtaining excellent low-temperature fixability, it is preferable to set the average thickness Dav. to 150.0 nm or less. The average thickness Dav. is more preferably 100.0 nm or less and still more preferably 50.0 nm or less.

The average thickness Dav. of the surface layer of the toner particle containing the organosilicon polymer can be controlled by the ratio of a hydrophilic group to a hydrophobic group, and the reaction temperature, the reaction time, the reaction solvent, and the pH in addition polymerization and condensation polymerization of the organosilicon polymer. The average thickness Dav. can also be controlled by the organosilicon polymer content.

It is suitable that, when the division axes each from the center to the toner particle surface are set to An (n=1 to 32), the length of each of the 32 division axes is defined as RAn (n=1 to 32), and the thickness of the surface layer on each of the division axes An is defined as FRAn (n=1 to 32) in the cross-sectional observation of the toner particle using a transmission electron microscope (TEM), the ratio of the number of the division axes on which the thickness of the surface layer of the toner particle containing the organosilicon polymer among the FRAns is 5.0 nm or less is 20.0% or less (Figure).

Due to the fact that the ratio of the number of the division axes on which the surface layer thickness is 5.0 nm or less is 20.0% or less among the FRAns, a toner excellent in fogging and image density stability even in a wide-range environment can be obtained.

The content of the organosilicon polymer in the toner particle is preferably 0.5% by mass or more and 2.0% by mass or less based on the total mass of the toner particle. When the content is 0.5% by mass or more, the shielding effect of the organosilicon polymer is sufficiently obtained and the heat resistance is improved. When the content is 2.0% by mass or less, the fixability inhibition due to the organosilicon polymer is suppressed to the minimum, so that good fixability is obtained.

As a typical method for producing the organosilicon polymer, a method referred to as a sol-gel method is mentioned.

The sol-gel method is a method including hydrolyzing and condensation-polymerizing metal alkoxide M(OR)n (M: Metal, O: Oxygen, R: Hydrocarbon, n: Oxidation number of metal) as a starting material in a solvent to form a sol, and then gelling the sol, and is used for the synthesis of glass, ceramics, organic-inorganic hybrids, and nanocomposites. According to the production method, functional materials of various shapes, such as a surface layer, a fiber, a bulk body, and a fine particle, can be produced from a liquid phase at low temperatures.

Specifically, the surface layer of the toner particle is suitably generated by hydrolysis polycondensation of the organosilicon compound typified by alkoxysilane. By providing the surface layer on the toner particle surface, a reduction in the performance of the toner in long-term use is hard to occur even when inorganic fine particles are not stuck or made to adhere to each other, which has been performed in a former toner, so that a toner excellent in storage stability is obtained.

Furthermore, according to the sol-gel method, materials are formed by gelling a solution as a starting material, and therefore various fine structures and shapes can be formed. Particularly when the toner particle is produced in an aqueous medium, the organosilicon polymer is easily caused to be present on the toner particle surface due to the hydrophilicity of a hydrophilic group, such as a silanol group, of the organosilicon compound. The fine structures and the shapes can be adjusted by the reaction temperature, the reaction time, the reaction solvent, the pH, the type and the amount of the organic metallic compound, and the like.

In general, it is known in the sol-gel reaction that the bonding state of the siloxane bond to be generated varies depending on the acidity of a reaction medium. Specifically, when the reaction medium is acidic, a hydrogen ion is electrophilically added to oxygen of one reactive group (for example, alkoxy group (—OR group)). Next, the oxygen atom in a water molecule coordinates on a silicon atom to form a hydrosilyl group due to a substitution reaction. When water is sufficiently present, one $H^+$ attacks one oxygen of the reactive group (for example, alkoxy group —OR group). Therefore, when the $H^+$ content in the reaction medium is low, the substitution reaction to the hydroxy group is retarded. Therefore, before all the reactive groups bonded to silane are hydrolyzed, a polycondensation reaction occurs, so that one-dimensional linear macromolecules and two-dimensional macromolecules are relatively easily generated.

On the other hand, when the reaction medium is alkaline, a hydroxide ion is added to silicon to form a pentacoordinated intermediate. Therefore, all the reactive groups (for example, alkoxy group (—OR group)) are easily desorbed and are easily substituted by a silanol group. Particularly when a silicon compound having three or more reactive groups bonded to the same silane is used, hydrolysis and polycondensation three-dimensionally occur, and an organosilicon polymer having a large number of three-dimensional crosslinking bonds is formed. Moreover, the reaction is completed in a short time.

Accordingly, in order to form the organosilicon polymer, it is suitable to advance the sol-gel reaction in a state where the reaction medium is alkaline. When produced in an aqueous medium, the pH is specifically suitably 8.0 or more.

Thus, an organosilicon polymer having higher strength and excellent durability can be formed. The sol-gel reaction is suitably performed at a reaction temperature of 90° C. or more for a reaction time of 5 hours or more.

By performing the sol-gel reaction at the reaction temperature for the reaction time, the formation of united particles in which the silane compounds in the sol or gel state on the toner particle surface are bonded can be suppressed.

When forming the organosilicon polymer, metal-based coupling agents may be used in combination from the viewpoint of controlling the charging of the surface layer. Examples of metal species include titanium, aluminum, zirconium, and the like. As the metal-based coupling agents, it is suitable to use titanium-based coupling agents and aluminum-based coupling agents.

Examples of the titanium-based coupling agents include the following substances. Mentioned are titanium methoxide, titanium ethoxide, titanium n-propoxide, tetra-i-propoxytitanium, tetra-n-butoxytitanium, titanium isobutoxide, titanium butoxide dimer, titanium tetra-2-ethylhexoxide, titanium diisopropoxy bis(acetylacetonate), titanium tetraacetylacetonate, titanium-di-2-ethylhexoxy bis ((2-ethyl-3-hydroxyhexoxide), titanium diisopropoxy bis (ethylacetoacetate), tetrakis (2-ethylhexyloxy)titanium, di-i-propoxy-bis(acetylacetonate)titanium, titanium lactate, titanium methacrylate isopropoxide, triisopropoxy titanate, titanium methoxy propoxide, and titanium stearyl oxide.

Examples of the aluminum-based coupling agents include the following substances. Mentioned are aluminum(III)n-butoxide, aluminum(III)s-butoxide, aluminum(III)s-butoxide bis(ethylacetoacetate), aluminum(III)t-butoxide, aluminum(III)-di-s-butoxide ethylacetoacetate, aluminum(III) diisopropoxide ethylacetoacetate, aluminum(III)ethoxide, aluminum(III)ethoxy ethoxy ethoxide, aluminum hexafluoropentanedionate, aluminum(III)3-hydroxy-2-methyl-4-pyronate, aluminum(III)isopropoxide, aluminum-9-octadecenyl acetoacetate diisopropoxide, aluminum(III)2,4-pentanedionate, aluminum phenoxide, and aluminum(III) 2,2,6,6-tetramethyl-3,5-heptanedionate.

These coupling agents may be used alone or in combination of two or more kinds thereof. By bonding the coupling agents as appropriate or changing the addition amount, the charge quantity can be adjusted.

Block Polymer

The block polymer of the present disclosure has the polyester segment C and the vinyl polymer segment A. The melting point (Tm) of the block polymer is 55° C. or more and 90° C. or less. When the melting point is lower than 55° C., blocking is likely to occur. Therefore, it is difficult to use the block polymer from the viewpoint of storage stability. When the melting point is higher than 90° C., the required temperature for melting the block polymer becomes higher. Therefore, it is difficult to use the block polymer from the viewpoint of low-temperature fixability. A more preferable melting point of the block polymer is 60° C. or more and 85° C. or less.

The melting point of the block polymer can be controlled by the monomer generating the polyester segment C and the mass ratio of the polyester segment C to the vinyl polymer segment A.

The polyester segment C of the block polymer has the structural unit represented by Formula (3) above. By the use of the polyester segment C having the structural unit, the styrene acrylic resin and the block polymer take a phase separated structure in the toner particles. Furthermore, the styrene acrylic resin and the block polymer enter a compatible state in melting of toner. Thus, the styrene acrylic resin is plasticized, so that the fixability is excellent.

The polyester segment C of the block polymer can be generated from dicarboxylic acid represented by the following formula (A) or an alkyl esterified substance thereof or an intramolecular acid anhydrous thereof and diol represented by the following formula (B). The polyester segment C is generated due to condensation polymerization thereof.

$$HOOC—(CH_2)m\text{-}COOH \qquad \text{Formula (A)}$$

(In Formula (A), m represents an integer of 4 or more and 16 or less (preferably 6 or more and 12 or less).)

$$HO—(CH_2)n\text{-}OH \qquad \text{Formula (B)}$$

(In Formula (B), n represents an integer of 4 or more and 16 or less (preferably 6 or more and 12 or less).)

In the structural unit represented by Formula (3) above, suitable values of m and n are 6 or more and 12 or less.

As the dicarboxylic acids, compounds in which a carboxyl group is alkyl-esterified (preferably carbon atoms of 1 to 4) or is formed into an intramolecular acid anhydrous, or the like may be used insofar as the compounds generate the same partial skeleton at the polyester segment C.

The dicarboxylic acids are suitably suberic acid, sebacic acid, dodecanedioic acid, tetradecanedioic acid, and the like.

The diols are suitably 1,5-pentanediol, 1,6-hexanediol, 1,7-heptanediol, 1,9-nonanediol, 1,10-decanediol, 1,12-dodecanediol, and the like.

For the composition of the vinyl polymer segment A of the block polymer, known vinyl monomers, such as styrene, methyl methacrylate, or n-butyl acrylate, can be used. The styrene is particularly preferable. The styrene effectively acts as the compatible portion with the styrene acrylic resin, and plasticization in melting is further demonstrated. The vinyl polymer segment A more suitably has a unit derived from the styrene.

The mass ratio of the polyester segment C to the vinyl polymer segment A (C/A ratio) of the block polymer is 40/60 or more and 80/20 or less. When the mass ratio is smaller than 40/60, the characteristics of the polyester segment C are lowered. Therefore, there is a tendency that the sharp melt property is impaired, so that the low-temperature fixability is poor. When the mass ratio is larger than 80/20, the characteristics of the polyester segment C are conversely strongly exhibited. Therefore, the durability tends to be poor.

The weight average molecular weight (Mw) of the block polymer is preferably 15000 or more and 45000 or less and more preferably 20000 or more and 45000 or less. The ratio (Mw/Mn) of the weight average molecular weight (Mw) of the block polymer to the number average molecular weight (Mn) of the block polymer is suitably 1.5 or more and 3.5 or less. When the weight average molecular weight is 15000 or more (more preferably 20000 or more), the mechanical strength of the block polymer is excellent and the durability thereof becomes high. When the weight average molecular weight is 45000 or less, the motion of molecules is difficult to be slow, which makes it easier to obtain the plasticizing effect. The weight average molecular weight is more preferably 23000 or more and 40000 or less and still more preferably 25000 or more and 37000 or less.

The block polymer content is preferably in the range of 2.0% by mass or more and 50.0% by mass or less and more preferably in the range of 6.0% by mass or more and 50.0% by mass or less based on the total of the block polymer and the styrene acrylic resin. The content is still more preferably 20.0% by mass or more and 40.0% by mass or less. When the content is 2.0% by mass or more (preferably 6.0% by mass or more), the plasticizing effect in melting and the binding effect caused by the block polymer which are the effects of the present disclosure are easily obtained, and the low-temperature fixability is improved. When the content is 50.0% by mass or less, the charge leak from the crystalline polyester segment C is hard to occur, the chargeability is hard to decrease, and fogging is hard to occur. Moreover, since the stress resistance is also hard to decrease, the durability is hard to decrease and adverse effects in images, such as vertical streak in the paper discharge direction, are hard to occur.

The block polymer is defined as a polymer configured from a plurality of linearly connected blocks (The Society of Polymer Science, Glossary of Basic Terms in Polymer Science by Commission on Macromolecular Nomenclature, International Union of Pure and Applied Chemistry), and the present disclosure also follows the definition.

Styrene Acrylic Resin

As the polymerizable monomer generating the styrene acrylic resin, a vinyl polymerizable monomer which can be radically polymerized can be used. As the vinyl polymerizable monomer, monofunctional polymerizable monomers or polyfunctional polymerizable monomers can be used. The monofunctional polymerizable monomer refers to a monomer having one polymerizable unsaturated group. The polyfunctional polymerizable monomer refers to a monomer having a plurality of polymerizable unsaturated groups.

Examples of the monofunctional polymerizable monomers include styrene, styrene derivatives, such as α-methylstyrene, β-methylstyrene, o-methylstyrene, m-methylstyrene, p-methylstyrene, 2, 4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-pentyl methacrylate, n-hexyl methacrylate, 2-ethylhexyl methacrylate, n-octyl methacrylate, n-nonyl methacrylate, diethylphosphateethyl dimethacrylate, and dibutylphosphateethyl dimethacrylate.

Examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinylether.

The monofunctional polymerizable monomers are used alone or in combination of two or more kinds thereof, the monofunctional polymerizable monomers and the polyfunctional polymerizable monomer are used in combination, or the polyfunctional polymerizable monomer are used alone or in combination of two or more kinds thereof. Among the polymerizable monomers, it is suitable from the viewpoint of the development characteristics and the durability of the toner to use styrene or styrene derivatives alone or as a mixture or as a mixture with other polymerizable monomers.

The SP value of the styrene acrylic resin is preferably 9.45 or more and 9.90 or less and more preferably 9.50 or more and 9.85 or less. The absolute value of the difference (ΔSP value) between the SP value of the styrene acrylic resin and the SP value of the block polymer is suitably 0.03 or more and 0.25 or less. Due to the fact that the value is within the range mentioned above, the styrene acrylic resin and the block polymer take a phase separated structure in the toner, and the resins are likely to enter a compatible state in melting, and thus it is easy to maintain the balance.

As a method for producing the toner particles according to the present disclosure, any method may be used. It is suitable to obtain the toner particles by a method for producing toner particles including granulating a polymerizable monomer composition in an aqueous medium, such as a suspension polymerization method, an emulsion polymerization method, or a suspension granulating method.

Hereinafter, the method for producing the toner particle is described using the suspension polymerization method which is the most suitable method among the methods for producing the toner particles for use in the present disclosure.

The polymerizable monomer capable of forming the styrene acrylic resin, the specific block polymer, and the organosilicon compound for forming the organosilicon polymer described above, and, as necessary, other additives, such as a colorant and wax, are uniformly dissolved or dispersed by a disperser. In the resultant mixture, a radical polymerization initiator (hereinafter also referred to as a polymerization initiator) is dissolved to prepare a polymerizable monomer composition. Next, the polymerizable monomer composition is suspended in an aqueous medium containing a dispersion stabilizer for polymerization. Subsequently, an organosilicon polymer is generated by the sol-gel reaction, whereby toner particles are produced. As the disperser, a homogenizer, a ball mill, a colloid mill, an ultrasonic disperser, and the like are mentioned, for example.

The polymerization initiator may be added simultaneously with the addition of other additives in the polymerizable monomer or may be added immediately before the suspending in an aqueous medium. Alternatively, a polymerization initiator dissolved in a polymerizable monomer or a solvent may be added immediately after the granulation and before the starting of the polymerization reaction.

Known wax components may be used as the wax for the present disclosure. Specific examples of the wax include petroleum-based wax, such as paraffin wax, microcrystalline wax, and petrolatum and derivatives thereof, montan wax and a derivative thereof, hydrocarbon wax obtained by the Fischer-Tropsch process and a derivative thereof, polyolefin wax typified by polyethylene and a derivative thereof, and natural wax, such as carnauba wax and candelilla wax and derivatives thereof. The derivatives include oxides, block copolymers with vinyl monomers, and graft-modified products. Moreover, alcohols, such as higher aliphatic alcohols; fatty acids, such as stearic acid and pulmitic acid, or acid amides, esters, and ketones thereof; hydrogenated castor oil and a derivative thereof, vegetable wax, and animal wax are mentioned. These substances can be used alone or in combination.

Among the above, when the polyolefin, the hydrocarbon wax obtained by the Fischer-Tropsch process, or the petroleum-based wax is used, the improvement effect of the developability or the transferability becomes higher. To these wax components, an antioxidant may be added insofar as the chargeability of the toner is not adversely affected. These wax components are suitably used in a proportion of 1 part by mass or more and 30 parts by mass or less based on 100 parts by mass of the binding resin (total of the styrene acrylic resin and the block polymer).

The melting point of the wax component for use in the present disclosure is preferably in the range of 30° C. or more and 120° C. or less and more preferably in the range of 60° C. or more and 100° C. or less.

By the use of the wax component exhibiting heat characteristics mentioned above, not only good fixability of the toner to be obtained but the mold release effect due to the wax component is efficiently revealed, and thus a sufficient fixing region is secured.

For the present disclosure, the following organic pigments, organic dyes, and inorganic pigments may be used as the colorant.

Examples of cyan colorants include copper phthalocyanine compounds and derivatives thereof, anthraquinone compounds, and basic dye lake compounds. Specifically, the following substances are mentioned. Mentioned are C.I. Pigment Blue 1, 7, 15, 15:1, 15:2, 15:3, 15:4, 60, 62, and 66.

As magenta colorants, the following substances are mentioned. Mentioned are condensed azo compounds, diketopyrrolopyrrole compounds, anthraquinones, quinacridone compounds, basic dye lake compounds, naphthol compounds, benzimidazolone compounds, thioindigo compounds, and perylene compounds. Specifically, the following substances are mentioned. Mentioned are C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, and 254 and C.I. Pigment Violet 19.

Examples of yellow colorants include condensed azo compounds, isoindolinone compounds, anthraquinone compounds, azo metal complexes, methine compounds, and allylamide compounds. Specifically, the following substances are mentioned. Mentioned are C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Examples of black colorants include carbon black and those whose color is adjusted to black color using the yellow colorants, the magenta colorants, and the cyan colorants mentioned above.

These colorants can be used alone or as a mixture or, further, in the state of a solid solution. The colorant for use in the present disclosure is selected from the viewpoints of the hue angle, the color saturation, the brightness, the lightfastness, the OHP transparency, and the dispersibility in the toner particles.

The colorant is suitably used in a proportion of 1 part by mass or more and 20 parts by mass or less based on 100 parts by mass of the binding resin (total of the styrene acrylic resin and the block polymer).

When obtaining the toner particles using the suspension polymerization method, it is suitable to use a colorant which is subjected to hydrophobic treatment with a substance free from polymerization inhibition in consideration of the polymerization inhibition properties and the transition properties to the aqueous phase. As a suitable method for subjecting a dye to the hydrophobic treatment, a method including polymerizing polymerizable monomers in the presence of these dyes beforehand to obtain a colored polymer is mentioned. The obtained colored polymer is added to the polymerizable monomer composition.

The carbon black may be treated with a substance (polyorganosiloxane) reacting with the surface functional group of the carbon black, in addition to the same hydrophobic treatment as that for the dyes.

Moreover, a charge control agent may be used as necessary. The charge control agent is suitably a charge control agent which has high triboelectric charging speed and which can stably maintain a fixed triboelectric charge quantity. Furthermore, when producing the toner particles by the suspension polymerization method, a charge control agent which has low polymerization inhibition properties and substantially does not contain a substance soluble in an aqueous medium is suitable.

As the charge control agent, a charge control agent which controls the toner to negative chargeability and a charge control agent which controls the toner to positive chargeability are mentioned. As those which control the toner to negative chargeability, the following substances are mentioned. Mentioned are monoazo metallic compounds, acetyl acetone metallic compounds, metallic compounds of aromatic oxycarboxylic acids, aromatic dicarboxylic acids, oxycarboxylic acids, and dicarboxylic acid-based, aromatic oxycarboxylic acids and aromatic mono- and poly-carboxylic acids and metal salts, anhydrides, and esters thereof, phenol derivatives, such as bisphenol, urea derivatives, metal containing salicylic acid-based compounds, metal containing naphthoic acid-based compound, boron compounds, quaternary ammonium salts, calyxarene, and charge control resin.

On the other hand, as the charge control agent which controls the toner to positive chargeability, the following substances are mentioned. Mentioned are guanidine compounds; imidazole compounds; quaternary ammonium salts, such as tributylbenzylammonium-1-hydroxy-4-naphthosulphonate and tetrabutyl ammonium tetrafluoroborate, onium salts, such as phosphonium salts which are analogues thereof, and lake pigments thereof; triphenylmethane dyes and lake pigments thereof (Examples of laking agents include phosphotungstic acid, phosphomolybdic acid, phosphotungstic molybdic acid, tannic acid, lauric acid, gallic acid, ferricyanide, and ferrocyanide.); metal salts of higher fatty acids; and charge control resin.

These charge control agents may be added alone or in combination of two or more kinds thereof.

Among the charge control agents mentioned above, the metal containing salicylic acid-based compounds are suitable, and those containing aluminum or zirconium as the metals are suitable.

The addition amount of the charge control agent is preferably 0.01 part by mass or more and 20 parts by mass or less and more preferably 0.5 part by mass or more and 10 parts by mass or less based on 100 parts by mass of the binding resin (total of the styrene acrylic resin and the block polymer).

As the charge control resin, polymers or copolymers having sulfonic acid groups, sulfonic acid bases, or sulfonic ester groups are suitably used. It is particularly suitable for the polymers having sulfonic acid groups, sulfonic acid bases, or sulfonic ester groups to contain sulfonic acid group containing acryl amide-based monomers or sulfonic acid group containing methacryl amide-based monomers in a proportion of 2% by mass or more in terms of copolymerization ratio. It is more suitable for the polymers to contain the same in a proportion of 5% by mass or more. The charge control resin is suitably one having a glass transition temperature (Tg) of 35° C. or more and 90° C. or less, a peak molecular weight (Mp) of 10,000 or more and 30,000 or less, and a weight average molecular weight (Mw) of 25,000 or more and 50,000 or less. When using the same, suitable triboelectric charge characteristics can be imparted without affecting the heat characteristics required in the toner particles. Since the charge control resin contains a sulfonic acid group, the dispersibility of the charge control resin itself in a dispersion liquid of the colorant and the dispersibility of the colorant can be improved, so that the tinting strength, the transparency, and the triboelectric charge characteristics can be further improved.

Examples of the radical polymerization initiator for polymerizing the polymerizable monomers include organic peroxide-based initiators and azo-based polymerization initiators. As the organic peroxide-based initiators, the following substances are mentioned. Mentioned are benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxy maleic acid, bis(t-butylperoxy)isophthalate, methyl ethyl ketone peroxide, tert-butylperoxy-2-ethyl hexanoate, diisopropyl peroxycarbonate, cumenehydroperoxide, 2,4-dichlorobenzoyl peroxide, tert-butyl-peroxypivalate, and the like.

Examples of the azo-based polymerization initiators include 2,2'-azobis(2,4-dimethylvaleronitrile), 2,2'-azobisisobutyronitrile, 1,1-azobis(cyclohexane-1-carbonitrile), 2,2'-azobis-4-methoxy-2,4-dimethylvaleronitrile, azobis methylbutyronitrile, and the like.

As the polymerization initiator, a redox-based initiator containing a combination of an oxidizing substance and a reducing substance can also be used. Examples of the oxidizing substance include inorganic peroxides, such as hydrogen peroxide and persulfates (sodium salt, potassium salt, and ammonium salt), and oxidizing metal salts, such as tetravalent cerium salt. Examples of the reducing substance include reducing metal salts (divalent iron salt, monovalent copper salt, and trivalent chromium salt), ammonia, lower amine (amine having about 1 to 6 carbon atoms, such as methylamine and ethylamine), amino compounds, such as hydroxylamine, reducing sulfuric compounds, such as sodium thiosulfate, sodium hydrosulfite, sodium bisulfite, sodium sulfite, and sodium formaldehydesulfoxylate, lower alcohols (1 to 6 carbon atoms), ascorbic acids or salts thereof, and lower aldehydes (1 to 6 carbon atoms).

The polymerization initiators are selected referring to a 10-hour half-life temperature and are utilized alone or as a mixture. The addition amount of the polymerization initiator varies according to the target degree of polymerization. The polymerization initiator is generally added in the amount of 0.5 part by mass or more 20 parts by mass or less based on 100 parts by mass of the polymerizable monomer.

Moreover, a known chain transfer agent and a polymerization inhibitor for controlling the degree of polymerization can be further added.

When polymerizing the polymerizable monomers, various crosslinking agents can also be used. Examples of the crosslinking agents include polyfunctional compounds, such as divinylbenzene, 4,4'-divinylphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

As a dispersion stabilizer to be used when preparing an aqueous medium, known inorganic compound dispersion stabilizers and organic compound dispersion stabilizers can be used. Examples of the inorganic compound dispersion stabilizers include tricalcium phosphate, magnesium phosphate, aluminium phosphate, zinc phosphate, calcium carbonate, magnesium carbonate, calcium hydroxide, magnesium hydroxide, aluminium hydroxide, calcium metasilicate, calcium sulfate, barium sulfate, bentonite, silica, and alumina. On the other hand, examples of the organic compound dispersion stabilizers include polyvinyl alcohol, gelatin, methylcellulose, methylhydroxypropyl cellulose, ethyl cellulose, sodium salt of carboxymethyl cellulose, polyacrylic acid and a salt thereof, and starch. The use amount of the dispersion stabilizers is preferably 0.2 part by mass or more and 20 parts by mass or less based on 100 parts by mass of the polymerizable monomers.

When using the inorganic compound dispersion stabilizers among these dispersion stabilizers, commercially-available one may be used as it is. However, in order to obtain a dispersion stabilizer having a finer particle diameter, an inorganic compound may be generated in an aqueous medium. For example, tricalcium phosphate is obtained by mixing an aqueous sodium phosphate solution and an aqueous calcium chloride solution under high-speed stirring.

To the toner particles, an external additive may be externally added in order to impart various characteristics to the toner. Examples of external agents for increasing the flowability of the toner include inorganic fine particles, such as silica fine particles, titanium oxide fine particles, and double oxide fine particles thereof. Among the inorganic particles, silica fine particles and titanium oxide fine particles are suitable. For example, the toner of the present disclosure can be obtained by externally adding and mixing the inorganic particles to the toner particles (which are sometimes referred to as toner base particles) to cause the inorganic particles to adhere to the toner particle surface. As a method for externally adding inorganic fine particles, known methods may be adopted. For example, a method for performing mixing processing using a Mitsui Henschel mixer (manufactured by (Mitsui Mining & Smelting Co., Ltd.) is mentioned.

Examples of the silica fine particles include dry silica generated by vapor phase oxidation of silicon halide, fumed silica, and wet silica produced from water glass. As the inorganic fine particles, dry silica in which the number of silanol groups on the surface of and inside the silica fine particle is small and the number of $Na_2O$ and $SO_3^{2-}$ is small is more suitable. The dry silica may be composite fine particles of silica and other metal oxides obtained by using metal halogen compounds, such as aluminum chloride and titanium chloride, with silicon halogen compounds in a production process.

The inorganic fine particles can achieve the adjustment of the triboelectric charge quantity, an improvement of environmental stability, and an improvement of flowability under high temperatures and high humidities of the toner by subjecting the surface to hydrophobic treatment with a treatment agent. Therefore, it is suitable to use the inorganic fine particles subjected to the hydrophobic treatment. When the inorganic fine particles externally added to the toner absorb moisture, the triboelectric charge quantity and the flowability of the toner decrease, so that a reduction in developability and transferability is likely to occur.

As the treatment agent for performing the hydrophobic treatment of the inorganic particles, the following substances are mentioned, for example. Mentioned are unmodified silicone varnishes, various modified silicone varnishes, unmodified silicone oils, various modified silicone oils, silane compounds, silane coupling agents, other organosilicon compounds, and organic titanium compounds. Among the above, silicone oil is suitable. The treatment agents may be used alone or in combination.

The total addition amount of the inorganic particles is preferably 0.1 part by mass or more and 2 parts by mass or less and more preferably 0.2 part by mass or more and 1 part by mass or less based on 100 parts by mass of the toner particles (toner base particles). The external additive preferably has a particle diameter of 1/10 or less of the average particle diameter of the toner particles from the viewpoint of the durability when added to the toner.

Hereinafter, methods for measuring the various physical properties according to the present disclosure are described.

Calculation Method for SP Value

The SP value in the present disclosure was determined using Expression (3) of Fedors. The Δei value and the Δvi values herein were defined referring to Evaporation energy and Molar volume (25° C.) of atoms and atom groups of Tables 3 to 9 of "Kothing no Kisokagaku (Basic chemical of coating)", 1986 (MAKI SHOTEN), pages: 54 to 57.

$$\delta i=[Ev/V]^{1/2}=[\Delta ei/\Delta vi]^{1/2} \quad \text{Expression (3)}$$

$E_v$: Evaporation energy

V: Molar volume

Δei: Evaporation energy of atoms and atom groups of i component

Δvi: Molar volume of atoms and atom groups of i component

For example, hexanediol contains an atom group (—OH)×2+(—$CH_2$)×6 and the calculated SP value is determined by the following expression.

$$\delta i=[\Delta ei/\Delta vi]^{1/2}=[\{(5220)\times 2+(1180\times 6)\}/\{(13)\times 2+(16.1)\times 6\}]^{1/2}$$

The SP value (δi) is 11.95.

Method for Measuring Molecular Weight

The weight average molecular weight (Mw) and the number average molecular weight (Mn) of the block polymer and the toner are measured by gel permeation chromatography (GPC) as follows. The weight average molecular weight of the toner means the weight average molecular weight obtained by measuring the THF soluble content of the toner.

First, a specimen is dissolved in tetrahydrofuran (THF) at room temperature. Then, the obtained solution is filtered through a solvent resistant membrane filter "MAESHORI DISK (manufactured by TOSOH CORP.) having a pore diameter of 0.2 μm to obtain a sample solution. The sample solution is adjusted in such a manner that the density of a component soluble in THF is 0.8% by mass. The measurement is performed using the sample solution under the following conditions.

Apparatus: High-speed GPC device "HLC-8220GPC" [manufactured by TOSOH CORP.]

Column: Twin LF-604 columns

Eluate: THF

Flow rate: 0.6 ml/min

Oven temperature: 40° C.

Specimen injection amount: 0.020 ml

For the calculation of the molecular weight of the specimen, a molecular weight calibration curve is used which is created using a standard polystyrene resin (for example, Trade name "TSK standard polystyrene F-850, F-450, F-288, F-128, F-80, F-40, F-20, F-10, F-4, F-2, F-1, A-5000, A-2500, A-1000, and A-500" manufactured by TOSOH CORP.). Method for measuring of ratio of polyester segment to vinyl polymer segment of block polymer The ratio of the polyester segment C to the vinyl polymer segment A of the block polymer was determined using the nuclear magnetic resonance spectroscopic analysis ($^1$H-NMR) [400 MHz, $CDCl_3$, room temperature (25° C.)].

Measurement apparatus: FT NMR apparatus JNM-EX400 (manufactured by JEOL Co., Ltd.)

Measurement frequency: 400 MHz

Pulse condition: 5.0 is

Frequency range: 10500 Hz

Total number of times: 64 times

The mass ratio (C/A ratio) of the polyester segment C to the vinyl polymer segment A was calculated from the obtained integral value of the spectra.

Method for Measuring of Melting Point

The melting point (Tm) of the block polymer is measured according to ASTM D3418-82 using a differential scanning calorimetry analyzer "Q1000" (manufactured by TA Instruments).

For the temperature correction of a device detecting unit, the melting points of indium and zinc are used. For the correction of the heat quantity, the heat of fusion of indium is used.

Specifically, 5 mg of the block polymer is accurately weighed, and then put in an aluminum pan. Then, the measurement is performed using an empty aluminum pan as a reference within the measurement temperature range of 30 to 200° C. at a temperature increase rate and a temperature decrease rate of 10° C./min. In the measurement, the temperature is increased to 200° C. once, and then continuously decreased to 30° C., and then the temperature is increased again. The maximum endothermic peak of the DSC curve within the temperature range of 30 to 200° C. in the second temperature increasing process is defined as the melting point (Tm) in the DSC measurement of the block polymer of the present disclosure.

Method for Confirming Partial Structures of Formulae (1) and (2)

A method for confirming the partial structures of Formulae (1) and (2) is as follows. The presence or absence of a methine group (>CH—) bonded to the silicon atom of Formula (1) or the presence or absence of a methylene group (—$CH_2$—), an ethylene group (—$CH_2$—$CH_2$—), and a phenylene group (-Ph-) bonded to the silicon atom of Formula (2) confirmed by $^{13}$C-NMR. The used apparatus and the measurement conditions are shown below.

Measurement Conditions

Apparatus: AVANCEIII 500 manufactured by BRUKER

Probe: 4 mm MAS BB/1H

Measurement temperature: Room temperature

Number of rotations of specimen: 6 kHz

Specimen: 150 mg of measurement specimen (THF insoluble matter of toner particles for NMR measurement) is put into a sample tube having a diameter of 4 mm.

The partial structure was confirmed by a signal (25 ppm) of the methine group (>CH—) bonded to the silicon atom of Formula (1). When the signal was able to be confirmed, the partial structure represented by Formula (1) was judged to be present.

The partial structure was confirmed by a signal of the methylene group (—$CH_2$—), the ethylene group (—$CH_2$—$CH_2$—), and the phenylene group (-Ph-) bonded to the silicon atom of Formula (2). When the signal was able to be confirmed, the partial structure represented by Formula (2) was judged to be present.

Measurement conditions of $^{13}$C-NMR (solid)

Measurement nucleus frequency: 125.77 MHz

Standard substance: Glycine (External standard: 176.03 ppm)

Observation width: 37.88 kHz

Measurement method: CP/MAS

Contact time: 1.75 ms

Repetition time: 4 s

Total number of times: 2048 times

LB value: 50 Hz

Measurement of Organosilicon Polymer Content

For the measurement of the organosilicon polymer content, a wavelength dispersion type X-ray fluorescence analyzer "Axios" (manufactured by PANalytical B.V.) and dedicated software attached thereto for analyzing the measurement condition setting and the measured data "Super Q Ver.4.0F" (manufactured by PANalytical B.V.) are used. An Rh anode is used as an anode of an X-ray tube, the measurement atmosphere is vacuum, the measurement diameter (the diameter of a collimator mask) is set to 27 mm, and the measurement time is set to 10 seconds. When measuring light elements, the elements are detected with a proportional counter (PC). When measuring heavy elements, the elements are detected with a scintillation counter (SC).

As a measuring sample, pellets are used which are molded into a thickness of 2 mm and a diameter of 39 mm by putting 4 g of the toner in a dedicated aluminum ring for pressing, leveling the toner, and pressing the same at 20 MPa for 60 seconds using a tablet molding/pressing machine "BRE-32" (manufactured by Maekawa Testing Machine Mfg. Co., Ltd.).

Silica ($SiO_2$) fine particles were added in such a manner as to be 0.10 part by mass based on 100 parts by mass of the toner particles not containing an organosilicon polymer, and then sufficiently mixed using a coffee mill. Similarly, silica fine powder is mixed with the toner particles in such a manner as to be 0.20 part by mass and 0.50 part by mass, and then the obtained mixtures are used as specimens for calibration curves.

With respect to the respective specimens, pellets of the specimens for the calibration curve are prepared as described above using a tablet molding/pressing machine, and then the counting rate (unit: cps) of Si-Kα rays observed at a diffraction angle (2θ)=109.080 when the pellets are used as analyzing crystals is measured. In this measurement, the accelerating voltage and current values of an X-ray generator are set to 24 kV and 100 mA, respectively. The counting rate of the obtained X-rays is plotted on the vertical axis and the addition amount of $SiO_2$ in the specimens for calibration curves is plotted on the horizontal axis to obtain a calibration curve of a linear function.

Next, the analysis target toner is formed into pellets using a tablet molding/pressing machine as described above, and then the counting rate of Si-Kα rays thereof is measured. Then, the organosilicon polymer content in the toner is determined from the calibration curve.

In the present disclosure, when the organic fine powder or the inorganic fine powder is externally added to the toner, the organic fine powder or the inorganic fine powder is removed by the following method to obtain toner particles.

160 g of sucrose (manufactured by Kishida Chemical Co., Ltd.) is added to 100 mL of ion exchange water, and then dissolved in a warm bath to prepare a concentrated sucrose liquid. 31 g of the concentrated sucrose liquid and 6 mL of Contaminon N (10% by mass aqueous solution of neutral detergent for washing precision measuring instruments having a pH of 7 containing a nonionic surfactant, an anionic surfactant, and an organic builder, manufactured by Wako Pure Chemical Industries, Ltd.) are put into a centrifugal separation tube to produce a dispersion liquid. 1.0 g of the toner is added to the dispersion liquid to break a toner mass with a spatula or the like.

The centrifugal separation tube is shaken with a shaker at 350 spm (strokes per min) for 20 min. After the shaking, the solution is transferred into a glass tube for swing rotor (50 mL), and then separated with a centrifugal separator under the conditions of 3500 rpm and 30 min. By the operation, the toner particles and the separated external additive are separated. Sufficient separation of the toner and the aqueous solution is visually checked, and then the toner separated into the top layer is extracted with a spatula or the like. The extracted toner is filtered with a vacuum filter, and then dried with a drier for 1 hour or more to obtain toner particles. This operation is carried out two or more times to secure a required amount. Measurement of average thickness Dav. of surface layer of toner particles and Ratio of toner particles having a surface layer thickness of 5.0 nm or less, measured by cross-sectional observation of toner particles using transmission electron microscope (TEM)

The cross-sectional observation of the toner particles of the present disclosure is performed by the following method.

As a specific method for observing the cross section of the toner particles, the toner particles are sufficiently dispersed in an epoxy resin which is curable at normal temperature, and then the resultant substance is cured for 2 days under a 40° C. atmosphere. A flaky sample is cut out from the obtained cured substance using a microtome having diamond teeth. The sample is enlarged to a magnification of 10,000 to 100,000 times with a transmission electron microscope (Electron microscope Tecnai TF, manufactured by FEI20XT) (TEM), and then the cross section of the toner particles is observed.

In the present disclosure, the confirmation is performed utilizing the fact that the contrast becomes higher when the atomic weight is larger, based on a difference in the atomic weight of the atoms in the resin and the organosilicon compound to be used. In order to give the contrast between the materials, a ruthenium tetroxide dyeing method and an osmium tetraoxide dyeing method are used. In the present disclosure, the sample formed into a flaky shape is put into a chamber using a vacuum electron dyeing device (VSC4R1H, manufactured by Filgen), and then dyeing treatment is performed at a density of 5 for a dyeing time of 15 min.

The particles used for the measurement are particles which have a circle-equivalent diameter Dtem value, which is determined from the cross section of the toner particles obtained from the TEM microphotograph above, within ±10% of the weight average particle diameter of the toner particles determined by a method described later.

As described above, a bright field image of the toner particle cross section is obtained at an accelerating voltage of 200 kV using an electron microscope Tecnai TF20XT manufactured by FEI. Next, an EF mapping image at the Si—K edge (99 eV) is obtained by a Three Window method using an EELS detector GIF Tridiem manufactured by Gatan, so that it is confirmed that the organosilicon polymer is present on the surface layer.

In one toner particle having a circle-equivalent diameter Dtem within ±10% of the weight average particle diameter of the toner particles, the toner particle cross section is equally divided into 16 parts around the intersection point of the major axis L of the toner particle cross section which is the largest diameter of the toner particle cross section and an axis L90 passing through the midpoint of and vertical to the major axis L (FIG. 1). More specifically, by drawing 16 straight lines crossing the cross section in such a manner that the straight lines pass through the middle point of the major axis L and the crossed axes angles at the middle point are equal (The crossed axes angle is 11.25°), 32 line segments are formed from the middle point to the toner particle surface. Next, the line segments (division axes) each extending from the middle point to the surface layer of the toner particle are denoted by An (n=1 to 32), the length of each line segment (division axis) is denoted by RAn, and the thickness of the surface layer on the line segments An is denoted by FRAn (n=1 to 32).

Then, the average thickness Dav. of the surface layer of one toner particle containing the organosilicon polymer at 32 places on the division axes is determined. The ratio of the number of the division axes on which the thickness of the surface layer of the toner particle containing the organosilicon polymer on each of the 32 division axes is 5.0 nm or less is determined.

In the present disclosure, 10 toner particles were measured for equalization, and then the average value per toner particle was calculated.

Circle-Equivalent Diameter (Dtem) Determined from Cross Section of Toner Particles Obtained from Transmission Electron Microscope (TEM) Photograph The circle-equivalent diameter (Dtem) determined from the toner particle cross section obtained from a TEM photograph is determined by the following method. First, the circle-equivalent diameter (Dtem) of one toner particle determined from the toner particle cross section obtained from a TEM photograph is determined according to the following equation.

$$\text{Circle-equivalent diameter } (Dtem) \text{ determined from toner particle cross section obtained from TEM photograph} = (RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24RA25+RA26+RA27+RA28+RA29+RA30+RA31+RA32/16.$$

The circle-equivalent diameters (Dtem) of the 10 toner particles are determined, and then the average value per toner particle is calculated to be defined as the circle-equivalent diameter (Dtem) determined from the toner particle cross section.

Measurement of Average Thickness (Dav.) of Surface Layer of Toner Particle

The average thickness (Dav.) of the surface layer of the toner particles is determined by the following method.

First, the average thickness $D_{(n)}$ of the surface layer of one toner particle is determined by the following method.

$$D_{(n)} = (\text{Total surface layer thickness at 32 places on division axes})/32 = (FRA1+FRA2+FRA3+FRA4+FRA5+FRA6+FRA7+FRA8+FRA9+FRA10+FRA11+FRA12+FRA13+FRA14+FRA15+FRA16+FRA17+FRA18+FRA19+FRA20+FRA21+FRA22+FRA23+FRA24+FRA25+FRA26+FRA27+FRA28+FRA29+FRA30+FRA31+FRA32)/32$$

The average thickness $D_{(n)}$ (n=1 to 10) of the surface layers of 10 toner particles is determined for equalization. Then, the average value per toner particle is calculated to be defined as the average thickness (Dav.).

$$Dav. = \{D_{(1)}+D_{(2)}+D_{(3)}+D_{(4)}+D_{(5)}+D_{(6)}+D_{(7)}+D_{(9)}+D_{(9)}+D_{(10)}\}/10$$

Measurement of Ratio of Surface Layer Thickness of 5.0 nm or Less $$[\text{Ratio in which the surface layer thickness } (FRAn) \text{ is 5.0 nm or less}] = [\{\text{Number of division axes on which the surface layer thickness } (FRAn) \text{ is 5.0 nm or less}\}/32] \times 100$$

This calculation is performed for 10 toner particles. Then, the average value of the obtained ratios in which the surface layer thickness (FRAn) of each of the 10 toner particles was 5.0 nm or less was determined to be defined as the ratio in which the surface layer thickness (FRAn) of the toner particles is 5.0 nm or less. Ratio of density of silicon atoms on toner particle surface (atomic %)

The density of silicon atom [dSi] (atomic percentage), the density of carbon atom [dC] (atomic percentage), the density of oxygen atom [dO] (atomic percentage), and the density of sulfur atom [dS] (atomic percent) present on the toner particle surface are determined by performing surface composition analysis employing electron spectroscopy for chemical analysis (ESCA).

In the present disclosure, the apparatus and the measurement conditions for ESCA are as follows.

Apparatus: Quantum 2000 manufactured by ULVAC-PHI, Inc.

X-ray photoelectron spectrometer measurement conditions:

X-ray source Al Kα

X-rays: 100 μm, 25 W, 15 kV

Raster: 300 μm×200 μm

Pass Energy: 58.70 eV

Step Size: 0.125 eV

Neutralization electron gun: 20 MA, 1 V

Ar ion gun: 7 mA, 10 V

Number of sweeps: Si 15, C 10, O 10, S 5

The density of silicon atom [dSi] (atomic percentage), the density of carbon atom [dC] (atomic percentage), the density of oxygen atom [dO] (atomic percentage), and the density of sulfur atom [dS] (atomic percentage) present on the toner particle surface are calculated from the measured peak intensity of each element using a relative sensitivity factor provided by PHI.

Method for Measuring Weight Average Particle Diameter (D4) and Number Average Particle Diameter (D1) of Toner The weight average particle diameter (D4) and the number average particle diameter (D1) of the toner are measured at a number of effective measuring channels of 25,000 using a precision particle size distribution analyzer having a 100 m aperture tube by an aperture impedance method "Coulter Counter Multisizer 3" (Registered Trademark, manufactured by Beckman Coulter, Inc.) and dedicated software for analyzing the measurement condition setting and the measured data attached thereto "Beckman Coulter Multisizer 3 Version 3.51" (manufactured by Beckman Coulter, Inc.). Then, the measured data are analyzed, and then the weight average particle diameter (D4) and the number average particle diameter (D1) of the toner are calculated.

Usable as an aqueous electrolyte solution for use in the measurement is one obtained by dissolving special grade sodium chloride in ion exchange water in such a manner that the concentration is 1% by mass, e.g., "ISOTON II" (manufactured by Beckman Coulter, Inc.).

Before the measurement and the analysis, the dedicated software is set as described below.

On the "Standard operation mode (SOM) setting screen" of the dedicated software, the total count number in control mode is set to 50000 particles, the number of measurements is set to 1, and the Kd value is set to a value obtained using "standard particles 10.0 μm" (manufactured by Beckman Coulter, Inc.). A threshold/noise level measurement button is pressed to automatically set the threshold and noise level. The current is set to 1600 μA, the gain is set to 2, and Isoton II is used as the electrolyte solution. Then, flushing of aperture tube after measurement is checked.

On the "Conversion of pulse to particle diameter setting screen" of the dedicated software, the bin interval is set to the logarithmic particle diameter, the particle diameter bin is set to 256 particle diameter bins, and the particle diameter range is set to 2 μm or more and 60 μm or less.

The specific measurement method is as follows.

(1) A 250 mL round bottom glass beaker exclusive for Multisizer 3 is charged with 200 mL of the aqueous electrolyte solution, and then placed on a sample stand. Then, a stirrer rod is rotated counterclockwise at 24 revolutions per second. Soiling and air bubbles in the aperture tube are removed using the "Aperture flushing" function of the analysis software.

(2) A 100 mL flat bottom glass beaker is charged with 30 mL of the aqueous electrolyte solution. Into the mixture, 0.3 mL of a diluted solution is added in which "Contaminon N" (10% by mass aqueous solution of a neutral detergent for washing precision measuring instruments having a pH of 7 containing a nonionic surfactant, an anionic surfactant, and an organic builder, manufactured by Wako Pure Chemical Industries, Ltd.) as a dispersant is diluted 3-fold by mass with ion exchange water.

(3) A predetermined amount of ion exchange water is poured into a water tank of an ultrasonic disperser "Ultrasonic Dispersion System Tetora 150" (manufactured by Nikkaki-Bios Co., Ltd.) having two oscillators having an oscillation frequency of 50 kHz at a phase difference of 180° and having an electrical output of 120 W, and then 2 mL of Contaminon N is added into the water tank.

(4) The beaker in (2) above is placed in a beaker-holding hole in the ultrasonic disperser, and the ultrasonic disperser is actuated. The height position of the beaker is adjusted in such a manner that the resonance state of the liquid level of the aqueous electrolyte in the beaker is highest.

(5) In a state where the aqueous electrolyte solution in the beaker in (4) above is irradiated with ultrasonic waves, 10 mg of the toner is added in a small portion to the aqueous electrolyte and is dispersed. The ultrasonic dispersion treatment is further continued for 60 seconds. During the ultrasonic dispersion, the water temperature of the water tank is controlled to be 10° C. or more and 40° C. or less.

(6) The aqueous electrolyte solution in which the toner is dispersed in (5) above is added dropwise using a pipette to the round bottom beaker in (1) placed on the sample stand, and then the measurement concentration is adjusted to be 5%. Then, the measurement is performed until the number of measured particles reaches 50,000.

(7) The measured data are analyzed by the dedicated software attached to the apparatus to calculate the weight average particle diameter (D4). The weight average particle diameter (D4) is "Average diameter" on the Analysis/Volume statistics (arithmetic mean) screen in the setting of graph/% by volume in the dedicated software. The number average particle diameter (D1) is "Average diameter" on the "Analysis/Number statistics (arithmetic mean)" screen in the setting of graph/% by number in the dedicated software.

EXAMPLES

Hereinafter, the present disclosure is more specifically described with reference to Examples. The present disclosure is not limited to Examples described below. Unless otherwise specified, "part(s)" and "%" in Examples and Comparative Examples are all based on mass.

First, block polymers used in Examples are described.

Production of Block Polymer 1

To a reaction vessel having a stirrer, a thermometer, a nitrogen introduction tube, a dehydrating tube, and a decompressor, 100.0 parts of sebacic acid and 105.0 parts of 1,12-dodecanediol were added, and then the reaction vessel was heated to a temperature of 130° C. under stirring. Then, 0.3 part of titanium (IV) isopropoxide as an esterification catalyst was added, the temperature was increased to 160° C., and then condensation polymerization was performed over 5 hours. Thereafter, the temperature was increased to 180° C., and then the resultant substance was reacted under reduced pressure until the molecular weight reached a desired molecular weight, whereby a polyester (1) was obtained. The weight average molecular weight (Mw) of the polyester (1) was 17000 and the melting point (Tm) thereof was 83° C.

Subsequently, 100.0 parts of the polyester (1) and 440.0 parts of dry chloroform were added to a reaction vessel having a stirrer, a thermometer, and a nitrogen introduction tube, and then completely dissolved. Thereafter, 5.0 parts of triethylamine was added, and then 15.0 parts of 2-bromoisobutyrylbromide was gradually added under ice cooling. Then, the resultant substance was stirred through one day and night at room temperature (25° C.).

The resin solution obtained above was gradually added dropwise to a vessel charged with 550.0 parts of methanol to reprecipitate the resin content, followed by filtration, purification, and drying to obtain a polyester (2).

Then, 100.0 parts of the polyester (2) obtained above, 120.0 parts of styrene, 3.0 parts of copper(I) bromide, and 6.5 parts of pentamethyldiethylenetriamine were added to a reaction vessel having a stirrer, a thermometer, and a nitrogen introduction tube. Then, a polymerization reaction was performed at a temperature of 110° C. while stirring the mixture. The reaction was stopped when the molecular weight reached a desired molecular weight, followed by reprecipitation with 250.0 parts of methanol, filtration, and purification for removal of the unreacted styrene and the catalyst. Then, drying was performed with a vacuum dryer set to 50° C. to obtain a block polymer 1 having a polyester segment C and a vinyl polymer segment A. The physical properties of the obtained block polymer 1 are shown in Table 3.

Production of Block Polymer 2

100.0 parts of xylene was heated while performing nitrogen substitution in a reaction vessel having a stirrer, a thermometer, a nitrogen introduction tube, and a decompressor, and then refluxed at a liquid temperature of 120° C. To the solution, a mixture of 100.0 parts of styrene and 9.0 parts of dimethyl 2,2'-azobis(2-methylpropionate) was added dropwise over 3 hours. After the completion of the dropwise addition, the solution was stirred for 3 hours. Thereafter, the xylene and the residual styrene were distilled off at 160° C. at 1 hPa to obtain a vinyl polymer (1).

Subsequently, 100.0 parts of the vinyl polymer (1) obtained above, 80.0 parts of xylene as an organic solvent, 145.5 parts of 1,12-dodecanediol, and 0.7 part of titanium (IV) isopropoxide as an esterification catalyst were added to a reaction vessel having a stirrer, a thermometer, a nitrogen introduction tube, a dehydrating tube, and a decompressor, and then the mixture was reacted at 150° C. for 4 hours under a nitrogen atmosphere. Thereafter, 125.3 parts of sebacic acid was added to the resultant substance, and then reacted at 150° C. for 3 hours and then at 180° C. 4 hours. Thereafter, the resultant substance was reacted at 180° C. at 1 hPa until the Mw reached a desired Mw to obtain a block polymer 2. The physical properties of the obtained block polymer 2 are shown in Table 3.

Production of Block Polymers 3 to 11 and 14 to 18

Block polymers 3 to 11 and 14 to 18 were obtained in the same manner as in the method for producing the block polymer 2, except changing the raw materials and the production conditions to those shown in Table 1. The physical properties of the obtained block polymers 3 to 11 and 14 to 18 are shown in Table 3.

Production of Block Polymers 12 and 13

Block polymers 12 and 13 were obtained in the same manner as in the method for producing the block polymer 1, except changing the raw materials to those shown in Table 1. The physical properties of the obtained block polymers 12 and 13 are shown in Table 3.

TABLE 3-continued

| | Physical properties | | | |
|---|---|---|---|---|
| Block polymer | Mw | C/A ratio | Tm | SP value |
| 6 | 18000 | 75/25 | 78 | 9.57 |
| 7 | 43000 | 75/25 | 78 | 9.57 |
| 8 | 15000 | 75/25 | 78 | 9.57 |
| 9 | 45000 | 75/25 | 78 | 9.57 |
| 10 | 13500 | 75/25 | 77 | 9.57 |
| 11 | 48000 | 75/25 | 78 | 9.57 |
| 12 | 25000 | 75/25 | 78 | 9.57 |
| 13 | 25000 | 75/25 | 72 | 9.76 |
| 14 | 25000 | 75/25 | 75 | 9.56 |
| 15 | 25000 | 60/40 | 65 | 9.79 |
| 16 | 25000 | 70/30 | 85 | 9.54 |
| 17 | 25000 | 35/75 | 72 | 9.70 |
| 18 | 25000 | 85/15 | 80 | 9.54 |

TABLE 1

| | Polyester segment C | | | | Vinyl polymer segmant A | | | |
|---|---|---|---|---|---|---|---|---|
| Block polymer | Acid monomer | Parts by mass | Alcohol monomer | Parts by mass | Vinyl monomer | Parts by mass | Parts of initiator | Reaction temperature |
| 2 | Sebacic acid | 125.3 | 1,12-dodecanediol | 145.4 | Styrene | 100 | 9.0 | 120 |
| 3 | Sebacic acid | 36.8 | 1,12-dodecanediol | 54.0 | Styrene | 100 | 9.0 | 120 |
| 4 | Sebacic acid | 175.5 | 1,12-dodecanediol | 194.3 | Styrene | 100 | 9.0 | 120 |
| 5 | Sebacic acid | 21.7 | 1,12-dodecanediol | 37.2 | Styrene | 100 | 9.0 | 120 |
| 6 | Sebacic acid | 125.3 | 1,12-dodecanediol | 145.4 | Styrene | 100 | 11.5 | 120 |
| 7 | Sebacic acid | 125.3 | 1,12-dodecanediol | 145.4 | Styrene | 100 | 6.0 | 120 |
| 8 | Sebacic acid | 125.3 | 1,12-dodecanediol | 145.4 | Styrene | 100 | 13.5 | 120 |
| 9 | Sebacic acid | 125.3 | 1,12-dodecanediol | 145.4 | Styrene | 100 | 6.0 | 120 |
| 10 | Sebacic acid | 125.3 | 1,12-dodecanediol | 125.3 | Styrene | 100 | 13.5 | 140 |
| 11 | Sebacic acid | 125.3 | 1,12-dodecanediol | 125.3 | Styrene | 100 | 5.0 | 120 |
| 14 | Dodecanedioic acid | 143.2 | 1,10-decanediol | 127.8 | Styrene | 100 | 9.0 | 120 |
| 15 | Sebacic acid | 81.9 | 1,6-hezanediol | 57.2 | Styrene | 100 | 9.0 | 120 |
| 16 | Dodecanedioic acid | 105.5 | 1,12-dodecanediol | 109.8 | Styrene | 100 | 9.0 | 120 |
| 17 | Sebacic acid | 125.3 | 1,12-dodecanediol | 125.3 | Styrene | 100 | 9.0 | 120 |
| 18 | Sebacic acid | 125.3 | 1,12-dodecanediol | 125.3 | Styrene | 100 | 9.0 | 120 |

TABLE 2

| | Polyester segment C | | | | Vinyl polymer segment A | | | |
|---|---|---|---|---|---|---|---|---|
| Block polymer | Acid monomer | Parts by mass | Alcohol monomer | Parts by mass | Vinyl monomer | Parts by mass | Vinyl monomer | Parts by mass |
| 1 | Sebacic acid | 100.0 | 1,12-dodecariediol | 105.5 | Styrene | 120.0 | — | — |
| 12 | Sebacic acid | 100.0 | 1,12-dodecanedol | 105.5 | MMA | 102.0 | t-BA | 18.0 |
| 13 | Sebacic acid | 100.0 | 1,9-nonanediol | 83.0 | Styrene | 82.8 | i-BA | 37.2 |

TABLE 3

| | Physical properties | | | |
|---|---|---|---|---|
| Block polymer | Mw | C/A ratio | Tm | SP value |
| 1 | 25000 | 70/30 | 78 | 9.59 |
| 2 | 25000 | 75/25 | 78 | 9.57 |
| 3 | 25000 | 50/50 | 76 | 9.65 |
| 4 | 25000 | 80/20 | 80 | 9.55 |
| 5 | 25000 | 40/60 | 74 | 9.69 |

In Table 3, the "C/A ratio" shows the mass ratio of the polyester segment C to the vinyl polymer segment A. The "SP value" shows the SP value of the block polymer.

Production of negatively chargeable control resin 1

To a reaction vessel which has a reflux tube, a stirrer, a thermometer, a nitrogen introduction tube, a dropping device, and a decompressor and which can be pressurized, 255.0 parts of methanol, 145.0 parts of 2-butanone, and 100.0 parts of 2-propanol were added as solvents, 88.0 parts of styrene, 6.0 parts of 2-ethylhexyl acrylate, and 5.0 parts of 2-acrylamide-2-methylpropanesulfonic acid were added as polymerizable monomers, and then the mixture was heated to a reflux temperature under stirring. A solution obtained by diluting 1.0 part of 2,2'-azobisisobutyronitrile which is a polymerization initiator with 20.0 parts of 2-butanone was added dropwise over 30 minutes, the mixture was stirred for 5 hours, and then the polymerization was stopped to obtain an aggregate.

Next, the aggregate obtained after distilling off the polymerization solvents under reduced pressure was roughly grounded to 100 μm or less with a cutter mill having a screen of 150 meshes (opening of 104 μm), and then pulverized with a jet mill. Then, the fine powder was classified with a sieve of 250 meshes (opening of 61 μm), and then particles of 60 pin or less were classified and obtained. Next, methyl ethyl ketone (MEK) was added and dissolved in such a manner that the concentration of the particles was 10%, and then the solution obtained above was gradually charged into methanol having an amount 20 times the amount of the MEK for the reprecipitation. The obtained precipitate was washed with methanol having an amount half the amount of the methanol used for the reprecipitation, and then the filtered particles were vacuum-dried at a temperature of 35° C. for 48 hours.

Furthermore, MEK was added in such a manner that the concentration of the particles after the vacuum drying was 10% for re-dissolving, and then the solution obtained above was gradually charged into n-hexane having an amount 20 times the amount of the MEK for reprecipitation. The obtained precipitate was washed with n-hexane having an amount half the amount of the n-hexane used for the reprecipitation, and then the filtered particles were vacuum-dried at a temperature of 35° C. for 48 hours to obtain a polar polymer. In the polar polymer thus obtained, the glass transition temperature (Tg) was 83° C., the main peak molecular weight (Mp) was 21,500, the number average molecular weight (Mn) was 11,000, the weight average molecular weight (Mw) was 33,000, and the acid value was 14.5 mgKOH/g. The composition measured by $^{1}$H-NMR (EX-400 manufactured by JEOL Co., Ltd.: 400 MHz) was styrene: 2-ethylhexyl acrylate: 2-acrylamide-2-methylpropanesulfonate=88.0:6.0:5.0 (mass ratio). The obtained polar polymer is a negatively chargeable control resin 1.

Production of Toner 1

To 1300.0 mass parts of ion exchange water warmed to a temperature of 60° C., 9.0 parts of tricalcium phosphate was added, and then the mixture was stirred at a stirring rate of 15,000 rpm using a TK Homomixer (Tokushu Kika Kogyo Co., Ltd.) to prepare an aqueous medium.

The following binding resin materials were mixed under stirring at a stirring rate of 100 rpm using a propeller stirring device to prepare a mixture liquid.

| | |
|---|---|
| Styrene | 70.2 parts |
| n-butyl acrylate | 19.8 parts |
| Block polymer 1 | 10.0 parts |
| Vinyltriethoxysilane | 5.0 parts |

To the mixture liquid,

| | |
|---|---|
| Cyan colorant (C.I. Pigment Blue 15:3) | 6.5 parts |
| Negatively charge control agent (BONTRON E-84, manufactured by Orient Chemical Industries Co., Ltd.) | 0.5 part |
| Hydrocarbon wax (Tm = 78° C.) | 9.0 parts |

-continued

| | |
|---|---|
| Negatively charge control resin 1 | 0.7 part |
| Polar resin (Styrene-2-hydroxyethyldimethacrylate-methacrylic acid-methylmethacrylate copolymer, Acid value of 10 mgKOH/g, Tg = 80° C., and Mw = 15,000) | 5.0 parts |

were added. Thereafter, the mixture liquid was warmed to a temperature of 65° C., stirred at a stirring rate of 10,000 rpm with a TK Homomixer, dissolved, and then dispersed to prepare a polymerizable monomer composition.

Subsequently, the polymerizable monomer composition was charged into the aqueous medium, and then 9.0 parts of Perbutyl PV (10-hour half-life temperature=54.6° C. (manufactured by NOF Corporation)) was added as a polymerization initiator. Then, the resultant mixture was stirred at a temperature of 72° C. for 20 minutes at a stirring rate of 15,000 rpm using a TK Homomixer for granulation.

The resultant substance was transferred to a propeller stirring device. Then, the styrene and the n-butyl acrylate, which were the polymerizable monomers in the polymerizable monomer composition, were polymerized at a temperature of 85° C. for 5 hours under stirring at a stirring rate of 200 rpm. Next, 1.0N—NaOH was added to adjust the pH to 7.2. Then, the temperature in the vessel was increased to a temperature of 100.0° C., and then a sol-gel reaction was performed for 5 hours to form an organosilicon polymer, whereby a slurry containing toner particles was produced. After the completion of the polymerization reaction, the slurry was cooled. Then, hydrochloric acid was added to the cooled slurry to adjust the pH to 1.4. Then, the calcium phosphate salt was dissolved by stirring for 1 hour. Thereafter, washing with water in an amount 10 times the amount of the slurry was performed, followed by filtration and drying. Then, classification was performed to adjust the particle diameter to obtain a toner 1. The physical properties of the toner 1 are shown in Table 5.

Production of Toners 2 to 23 and Toners 25 to 31

Toners 2 to 23 and toners 25 to 31 were obtained by the same production method as that of the toner 1, except changing the raw materials and the parts of addition as shown in Table 4.

Production of Toner 24

| | |
|---|---|
| Styrene-acrylic resin (Styrene:Copolymer of n-butyl acrylate = 80:20 (mass ratio)) (Mw = 30,000, Tg = 55° C.) | 90.0 parts |
| Block polymer 2 | 10.0 parts |
| Methyl ethyl ketone | 100.0 parts |
| Ethyl acetate | 100.0 parts |
| Hydrocarbon wax (Tm = 78° C.) | 9.0 parts |
| Cyan colorant (C.I. Pigment Blue 15:3) | 6.5 parts |
| Negatively charge control resin 1 | 1.0 part |
| Vinyl triethoxysilane | 5.0 parts |

The materials above were dispersed for 3 hours using an Attritor (manufactured by Mitsui Mining & Smelting Co., Ltd.) to obtain a colorant dispersion liquid.

Separately, 27.0 parts of calcium phosphate was added to 3000.0 parts of ion exchange water warmed to a temperature of 60° C., and then stirred at a stirring rate of 10,000 rpm using a TK Homomixer to prepare an aqueous medium. The colorant dispersion liquid was charged into the aqueous medium, and then stirred for 15 minutes at a stirring rate of 12,000 rpm using a TK Homomixer under an $N_2$ atmosphere at a temperature of 65° C. to granulate colorant particles. Thereafter, the TK Homomixer was replaced with an ordinary propeller stirring device. Then, the stirring rate of the stirrer was maintained at 150 rpm, and then the internal temperature was increased to a temperature of 95° C. and held for 3 hours to remove the solvent from the dispersion liquid to prepare a toner particle dispersion liquid.

Hydrochloric acid was added to the obtained toner particle dispersion liquid to adjust the pH to 1.4, and then stirred for 1 hour to dissolve the calcium phosphate. The dispersion liquid was filtered and washed with a pressure filter to obtain a toner aggregate. Then, the toner aggregate was pulverized, and then dried to obtain a toner 24. The physical properties of the toner 24 are shown in Table 5.

TABLE 4

| | Binding resin | | | | Organosilicon polymer | |
|---|---|---|---|---|---|---|
| | Block Polymer | Parts by mass | Styrene acrylic resin | Parts by mass | Monomer | Parts |
| Toner-1 | 1 | 10.0 | Styrene:n-butyl acrylate 78:22 | 90.0 | Vinylethoxysilane | 5.0 |
| Toner-2 | 1 | 5.0 | Styrene:n-butyl acrylate 78:22 | 95.0 | Vinylethoxysilane | 5.0 |
| Toner-3 | 1 | 35.0 | Styrene:n-butyl acrylate 78:22 | 65.0 | Vinylethoxysilane | 5.0 |
| Toner-4 | 2 | 10.0 | Styrene:n-butyl acrylate 78:22 | 90.0 | Vinylethoxysilane | 5.0 |
| Toner-5 | 3 | 10.0 | Styrene:n-butyl acrylate 78:22 | 90.0 | Vinylethoxysilane | 5.0 |
| Toner-6 | 4 | 10.0 | Styrene:n-butyl acrylate 78:22 | 90.0 | Vinylethoxysilane | 5.0 |
| Toner-7 | 5 | 10.0 | Styrene:n-butyl acrylate 78:22 | 90.0 | Vinylethoxysilane | 5.0 |
| Toner-8 | 6 | 10.0 | Styrene:n-butyl acrylate 78:22 | 90.0 | Vinylethoxysilane | 5.0 |
| Toner-9 | 7 | 10.0 | Styrene:n-butyl acrylate 78:22 | 90.0 | Vinylethoxysilane | 5.0 |
| Toner-10 | 8 | 10.0 | Styrene:n-butyl acrylate 78:22 | 90.0 | Vinylethoxysilane | 5.0 |
| Toner-11 | 9 | 10.0 | Styrene:n-butyl acrylate 78:22 | 90.0 | Vinylethoxysilane | 5.0 |
| Toner-12 | 10 | 10.0 | Styrene:n-butyl acrylate 78:22 | 90.0 | Vinylethoxysilane | 5.0 |
| Toner-13 | 11 | 10.0 | Styrene:n-butyl acrylate 78:22 | 90.0 | Vinylethoxysilane | 5.0 |
| Toner-14 | 12 | 10.0 | Styrene:n-butyl acrylate 78:22 | 90.0 | Vinylethoxysilane | 5.0 |
| Toner-15 | 13 | 10.0 | Styrene:n-butyl acrylate 78:22 | 90.0 | Vinylethoxysilane | 5.0 |
| Toner-16 | 14 | 10.0 | Styrene:n-butyl acrylate 78:22 | 90.0 | Vinylethoxysilane | 5.0 |
| Toner-17 | 15 | 10.0 | Styrene:n-butyl acrylate 78:22 | 90.0 | Vinylethoxysilane | 5.0 |
| Toner-18 | 16 | 10.0 | Styrene:n-butyl acrylate 78:22 | 90.0 | Vinylethoxysilane | 5.0 |
| Toner-19 | 13 | 10.0 | Styrene:n-butyl acrylate 78:22 | 90.0 | Vinylethoxysilane | 5.0 |
| Toner-20 | 13 | 10.0 | Styrene:n-butyl acrylate 78:22 | 90.0 | Vinylethoxysilane | 5.0 |
| Toner-21 | 2 | 10.0 | Styrene:n-butyl acrylate 78:22 | 90.0 | Vinylethoxysilane | 2.0 |
| Toner-22 | 2 | 10.0 | Styrene:n-butyl acrylate 78:22 | 90.0 | Vinylethoxysilane | 15.0 |
| Toner-23 | 2 | 10.0 | Styrene:n-butyl acrylate 78:22 | 90.0 | Vinylethoxysilane | 1.0 |
| Toner-24 | 2 | 10.0 | Styrene:n-butyl acrylate 78:22 | 90.0 | Vinylethoxysilane | 20.0 |
| Toner-25 | 2 | 10.0 | Styrene:n-butyl acrylate 78:22 | 90.0 | Vinylethoxysilane | 2.0 |
| Toner-26 | 2 | 10.0 | Styrene:n-butyl acrylate 78:22 | 90.0 | Vinylethoxysilane | 5.0 |
| Toner-27 | 2 | 10.0 | Styrene:n-butyl acrylate 78:22 | 90.0 | Styryltriethoxysilane | 5.0 |
| Toner-28 | 13 | 10.0 | Styrene:n-butyl acrylate 78:22 | 90.0 | Metacryloxypropyltriethoxysilane | 5.0 |
| Toner-29 | 13 | 10.0 | Styrene:n-butyl acrylate 78:22 | 90.0 | Aminopropyltriethoxysilane | 5.0 |
| Toner-30 | 17 | 10.0 | Styrene:n-butyl acrylate 78:22 | 90.0 | Vinylethoxysilane | 5.0 |
| Toner-31 | 18 | 10.0 | Styrene:n-butyl acrylate 78:22 | 90.0 | Vinylethoxysilane | 5.0 |

TABLE 5

| | Toner physical properties | | | | | |
|---|---|---|---|---|---|---|
| | ΔSP value | dSi | Silicon polymer content | D1 (μm) | D4 (μm) | Mw |
| Toner-1 | 0.21 | 12.5 | 1.5 | 5.0 | 5.5 | 32000 |
| Toner-2 | 0.21 | 12.5 | 1.5 | 4.9 | 5.4 | 33000 |
| Toner-3 | 0.21 | 12.5 | 1.5 | 5.7 | 6.2 | 35500 |
| Toner-4 | 0.23 | 12.5 | 1.5 | 4.8 | 5.6 | 31500 |
| Toner-5 | 0.15 | 12.5 | 1.5 | 4.8 | 5.3 | 33000 |
| Toner-6 | 0.25 | 12.5 | 1.5 | 5.2 | 5.8 | 30000 |
| Toner-7 | 0.11 | 12.5 | 1.5 | 5.3 | 5.8 | 32000 |
| Toner-8 | 0.23 | 12.5 | 1.5 | 5.0 | 5.6 | 31000 |
| Toner-9 | 0.23 | 12.5 | 1.5 | 5.1 | 5.5 | 34500 |
| Toner-10 | 0.23 | 12.5 | 1.5 | 5.2 | 5.9 | 34000 |
| Toner-11 | 0.23 | 12.5 | 1.5 | 4.8 | 5.5 | 34000 |
| Toner-12 | 0.23 | 12.5 | 1.5 | 4.9 | 5.5 | 35000 |
| Toner-13 | 0.23 | 12.5 | 1.5 | 4.8 | 5.6 | 32000 |
| Toner-14 | 0.23 | 12.5 | 1.5 | 4.7 | 5.7 | 34000 |
| Toner-15 | 0.04 | 12.5 | 1.5 | 4.8 | 5.8 | 33000 |
| Toner-16 | 0.24 | 12.5 | 1.5 | 4.9 | 6.1 | 39000 |
| Toner-17 | 0.01 | 12.5 | 1.5 | 5.0 | 5.9 | 32000 |

TABLE 5-continued

| | Toner physical properties | | | | | |
|---|---|---|---|---|---|---|
| | ΔSP value | dSi | Silicon polymer content | D1 (μm) | D4 (μm) | Mw |
| Toner-18 | 0.26 | 12.5 | 1.5 | 4.7 | 6.0 | 32500 |
| Toner-19 | 0.04 | 4.0 | 1.5 | 4.6 | 5.6 | 31500 |
| Toner-20 | 0.04 | 2.0 | 1.5 | 4.7 | 5.8 | 33500 |
| Toner-21 | 0.23 | 12.5 | 0.5 | 4.9 | 5.4 | 33000 |

TABLE 5-continued

| | Toner physical properties | | | | | |
|---|---|---|---|---|---|---|
| | ΔSP value | dSi | Silicon polymer content | D1 (μm) | D4 (μm) | Mw |
| Toner-22 | 0.23 | 12.5 | 2.0 | 5.0 | 6.1 | 35000 |
| Toner-23 | 0.23 | 12.5 | 0.3 | 5.1 | 5.8 | 34000 |
| Toner-24 | 0.23 | 12.5 | 2.5 | 4.5 | 5.9 | 33000 |
| Toner-25 | 0.23 | 12.5 | 0.5 | 4.9 | 5.6 | 35000 |
| Toner-26 | 0.23 | 12.5 | 1.5 | 4.8 | 5.7 | 33000 |
| Toner-27 | 0.23 | 12.5 | 1.5 | 4.9 | 5.9 | 35000 |
| Toner-28 | 0.04 | 12.5 | 1.5 | 4.7 | 5.7 | 34000 |
| Toner-29 | 0.04 | 12.5 | 1.5 | 5.0 | 5.8 | 36000 |
| Toner-30 | 0.10 | 12.5 | 1.5 | 4.7 | 5.6 | 32000 |
| Toner-31 | 0.26 | 12.5 | 1.5 | 4.8 | 5.4 | 33000 |

Image Evaluation

Image evaluation was performed by partially modifying a color laser printer (HP Color LaserJet 3525dn). As a modification, the printer was modified to be able to operate by installing only a single color process cartridge. As another modification, the printer was modified so that the temperature of a fixing unit was able to be changed to an arbitrary temperature.

From a process cartridge for black toner installed in the color laser printer, the toner contained therein was extracted, and the inside was cleaned with air blow. Then, each toner (300 g) was introduced into the process cartridge, the process cartridge in which the toner was repacked was attached to the color laser printer, and then the following image evaluations were performed. In each evaluation, the ranks A, B, and C are the levels at which the effects of the present disclosure are obtained. Specific image evaluation criteria are as follows.

Low-Temperature Fixability

Solid images (Toner applied amount: 0.9 mg/cm$^2$) were printed to a transfer material while changing the fixing temperature, and then evaluated according to the following criteria. The fixing temperature is a value obtained by measuring the surface of a fixing roller using a non-contact thermometer. As the transfer material, a LETTER-size plain paper (XEROX 4200, manufactured by XEROX, 75 g/m$^2$) was used.

Evaluation Criteria

A: Offset did not occur at 100° C.

B: Offset occurred at 100° C.

C: Offset occurred at 110° C.

D: Offset occurred at 120° C.

Streak 30000 images were formed with horizontal lines at a printing ratio of 1% in a low temperature and low humidity environment (Temperature 15° C./Humidity 10% RH). After the completion of the formation of the 30000 images, a halftone (toner applied amount: 0.6 mg/cm$^2$) image was printed out on a LETTER-size Xerox 4200 paper (manufactured by Xerox Corporation, 75 g/m$^2$). Then, the presence or absence of vertical streaks in the paper discharge direction in the halftone image was observed, and then the durability was evaluated as follows. The toner excellent in durability is hard to be crushed or broken and is difficult to adhere to a developing roller, and thus streaks are hard to occur.

Evaluation Criteria

A: Streaks were not generated.

B: Vertical streaks were generated at 1 (inclusive) to 3 (inclusive) places in the paper discharge direction on the image of the half-tone portion.

C: Vertical streaks were generated at 4 (inclusive) to 6 (inclusive) places in the paper discharge direction on the image of the half-tone portion.

D: Vertical streak were generated at 7 or more places in the paper discharge direction on the image of the half-tone portion or vertical streaks with a width of 0.5 mm or more were generated.

Fogging 30000 images were formed with horizontal lines at a printing ratio of 1% in a high temperature and high humidity environment (Temperature 33° C./Humidity 85% RH). After the completion of the formation of the 30000 images, the reflectance (%) of a non-image area of a further printed-out image after allowed to stand for 48 hours was measured by "REFLECTOMETERMODEL TC-6DS" (manufactured by Tokyo Denshoku. Co., Ltd.). The fogging was evaluated using a numerical value (%) obtained by deducting the obtained reflectance from the similarly measured reflectance (%) of an unused print out paper (standard paper). A smaller numerical value shows that the image fogging is further suppressed. The evaluation was performed in a gross paper mode using a plain paper (HP Brochure Paper 200 g, Glossy, manufactured by HP, 200 g/m$^2$).

Evaluation Criteria

A: Less than 0.5%

B: 0.5% or more and less than 1.5%

C: 1.5% or more and less than 3.0%

D: 3.0% or more

Blocking 5 g of each toner was taken in a 50 mL resin cup, and then allowed to stand at a temperature of 60° C. and a humidity of 10% RH for 3 days. Then, the presence or absence of a cohesion cluster was checked, and then evaluated according to the following criteria.

Evaluation Criteria

A: No cohesion clusters were not generated.

B: A slight cohesion cluster was generated and was collapsed by being slightly pressed with a finger.

B: A cohesion cluster was generated and was not collapsed even by being slightly pressed with a finger.

D: The toner was completely aggregated.

Examples 1 to 27

In Examples 1 to 27, the evaluation was performed using the toners 1 to 27 as the toners, respectively. The evaluation results are shown in Table 6.

Comparative Examples 1 to 4

In Comparative Examples 1 to 4, the evaluation was performed using the toners 28 to 31 as the toners, respectively. The evaluation results are shown in Table 6.

TABLE 6

| | | Fixability Low-temperature fixation (Fixable temperature) | Storage stability Blocking 60° C. | Development · Durability Streak | Development · Durability Fogging |
|---|---|---|---|---|---|
| Ex. 1 | Toner-1 | A (95) | A | A | A (0.2) |
| Ex. 2 | Toner-2 | A (98) | A | A | A (0.4) |
| Ex. 3 | Toner-3 | A (93) | A | A | A (0.3) |
| Ex. 4 | Toner-4 | A (95) | A | A | A (0.3) |
| Ex. 5 | Toner-5 | A (98) | A | A | A (0.4) |
| Ex. 6 | Toner-6 | A (95) | B | B (1) | A (0.3) |
| Ex. 7 | Toner-7 | C (115) | A | A | A (0.4) |
| Ex. 8 | Toner-8 | A (95) | A | A | A (0.3) |
| Ex. 9 | Toner-9 | A (95) | A | A | A (0.2) |
| Ex. 10 | Toner-10 | A (98) | B | B (1) | A (0.2) |
| Ex. 11 | Toner-11 | B (105) | A | A | A (0.3) |
| Ex. 12 | Toner-12 | A (95) | C | B (3) | A (0.3) |
| Ex. 13 | Toner-13 | C (118) | A | A | A (0.3) |
| Ex. 14 | Toner-14 | B (105) | A | A | A (0.2) |
| Ex. 15 | Toner-15 | A (95) | A | A | A (0.3) |
| Ex. 16 | Toner-16 | A (98) | A | A | A (0.3) |
| Ex. 17 | Toner-17 | A (95) | B | A | B (0.7) |
| Ex. 18 | Toner-18 | B (105) | A | A | A (0.3) |
| Ex. 19 | Toner-19 | A (95) | A | A | A (0.4) |
| Ex. 20 | Toner-20 | A (95) | B | B (2) | B (1.4) |
| Ex. 21 | Toner-21 | A (95) | A | A | A (0.3) |
| Ex. 22 | Toner-22 | A (98) | A | A | A (0.4) |
| Ex. 23 | Toner-23 | A (95) | C | C (4) | A (0.3) |
| Ex. 24 | Toner-24 | C (115) | A | A | A (0.4) |
| Ex. 25 | Toner-25 | A (98) | B | A | B (0.8) |
| Ex. 26 | Toner-26 | A (95) | A | A | A (0.2) |
| Ex. 27 | Toner-27 | A (95) | A | A | A (0.2) |
| Comp. Ex. 1 | Toner-28 | A (98) | D | C (5) | C (2.2) |
| Comp. Ex. 2 | Toner-29 | A (98) | D | C (5) | C (2.5) |

TABLE 6-continued

| | | Fixability Low-temperature fixation (Fixable temperature) | Storage stability Blocking 60° C. | Development · Durability Streak | Fogging |
|---|---|---|---|---|---|
| Comp. Ex. 3 | Toner-30 | D (150) | D | D (10) | D (3.8) |
| Comp. Ex. 4 | Toner-31 | D (145) | D | D (Many streaks having a width of 0.5 mm or more) | D (5.5) |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-095773, filed May 8, 2015 which is hereby incorporated by reference herein in its entirety.

What is claimed is:

1. A toner, comprising:

a toner particle including a surface layer, wherein, the toner particle comprises a styrene acrylic resin and a block polymer, the surface layer comprises an organosilicon polymer, the organosilicon polymer has a partial structure represented by Formula (1) or (2) shown below,

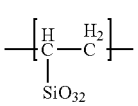

(1)

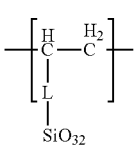

(2)

in Formulae (1) and (2), L represents a methylene group, an ethylene group, or a phenylene group, the block polymer has a polyester segment C and a vinyl polymer segment A, a melting point (Tm) of the block polymer is 55° C. or more and 90° C. or less, a ratio (C/A ratio) of the polyester segment C to the vinyl polymer segment A is 40/60 or more and 80/20 or less, and the polyester segment C has a structural unit represented by Formula (3) shown below,

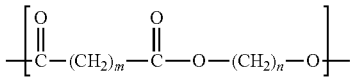

(3)

in Formula (3), m and n each independently represent an integer of 4 or more and 16 or less.

2. The toner according to claim 1, wherein a weight average molecular weight (Mw) of the block polymer is 15000 or more and 45000 or less.

3. The toner according to claim 1, wherein the vinyl polymer segment A has a unit derived from styrene.

4. The toner according to claim 1, wherein an absolute value of a difference (ΔSP value) between an SP value of the styrene acrylic resin and an SP value of the block polymer is 0.03 or more and 0.25 or less.

5. The toner according to claim 1, wherein a ratio of a density of a silicon atom on a surface of the toner particle determined by Expression (5) shown below in X ray photoelectron spectrometry (ESCA) of the surface of the toner particle is 1.0 atomic % or more, $$\{dSi/(dC+dO+dSi+dS)\}\times 100 \quad (5),$$

wherein, in Expression (5), dC represents a density of a carbon atom, dO represents a density of an oxygen atom, dSi represents a density of the silicon atom, and dS represents a density of a sulfur atom.

6. The toner according to claim 1, wherein a content of the organosilicon polymer is 0.5% by mass or more and 2.0% by mass or less based on a total mass of the toner particle.

7. The toner according to claim 1, wherein m and n in Formula (3) above each independently represent an integer of 6 or more and 12 or less.

8. A method for producing the toner according to claim 1, the method comprising the steps of:

granulating a polymerizable monomer composition containing a polymerizable monomer capable of generating the styrene acrylic resin, the block polymer, and a silicon compound capable of generating the organosilicon polymer in an aqueous medium, and polymerizing the polymerizable monomers.

* * * * *